US006521388B2

(12) United States Patent
Kabata et al.

(10) Patent No.: US 6,521,388 B2
(45) Date of Patent: Feb. 18, 2003

(54) ELECTROPHOTOGRAPHIC IMAGE FORMING APPARATUS, AND PHOTORECEPTOR THEREFOR

(75) Inventors: Toshiyuki Kabata, Yokohama (JP); Toshio Fukagai, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 42 days.

(21) Appl. No.: 09/835,496

(22) Filed: Apr. 17, 2001

(65) Prior Publication Data

US 2001/0044062 A1 Nov. 22, 2001

(30) Foreign Application Priority Data

Apr. 17, 2000 (JP) ..... 2000-114902
Apr. 4, 2001 (JP) ..... 2001-105790

(51) Int. Cl.[7] ..... G03G 5/14

(52) U.S. Cl. ..... 430/60; 430/56; 399/177; 399/220; 399/221; 399/159

(58) Field of Search ..... 430/60, 56; 399/177, 399/220, 221, 159

(56) References Cited

U.S. PATENT DOCUMENTS 4,705,735 A 11/1987 Saitoh et al.
4,904,557 A 2/1990 Kubo
5,707,767 A 1/1998 Yu

FOREIGN PATENT DOCUMENTS

JP 57165845 A 10/1982
JP 06-208237 7/1994
JP 07295269 A 11/1995
JP 10301311 A 11/1998

OTHER PUBLICATIONS

Patent Abstracts of Japan, JP 60–254168, Dec. 14, 1985.
Patent Abstracts of Japan, AN–2000–228450, JP 2000–047415, Feb. 18, 2000.
Patent Abstracts of Japan, JP 11–305472, Nov. 5, 1999.
Patent Abstracts of Japan, AN–1990–316891, JP 2–226161, Sep. 7, 1990.

*Primary Examiner*—Mark A. Chapman
(74) *Attorney, Agent, or Firm*—Oblon, Spivak, McClelland, Maier & Neustadt, P.C.

(57) ABSTRACT

An image forming apparatus including a photoreceptor including a photosensitive layer on a surface of an electroconductive substrate and a light irradiator configured to irradiate the photoreceptor with a light beam having a wavelength $\lambda$ represented in units of micrometers and a diameter $\phi$ represented in units of micrometers to form a dot latent image on the photoreceptor, wherein a maximum height in a part of a profile of the lower surface of the photosensitive layer in a sampling range of $\phi$ is not less than $\lambda/(2n)$, where n is a refractive index of the photosensitive layer at the wavelength $\lambda$.

35 Claims, 11 Drawing Sheets

ELECTROPHOTOGRAPHIC IMAGE FORMING APPARATUS, AND PHOTORECEPTOR THEREFOR

BACKGROUND OF THE INVENTION

1. Field of the Invention

The present invention relates to an electrophotographic image forming apparatus using a photoreceptor and coherent light such as laser light for writing a latent image on the photoreceptor. The present invention also relates a photoreceptor for the image forming apparatus.

2. Discussion of the Background

Electrophotographic image forming methods using coherent light such as laser light for writing an electrostatic latent image on a photoreceptor are widely used for digital image forming apparatus such as copiers, printers and facsimile machines.

The image forming methods using coherent light for writing a latent image on a photoreceptor have a drawback such that the resultant images have a stripe image having uneven density because the coherent light interferes in the photosensitive layer of the photoreceptor. It is known that such undesired stripe images are produced when the following relationship is satisfied:

$$2nd=m\lambda$$

wherein n represents the refractive index of the photosensitive layer when measured by the light used for image writing; d represents the thickness of the photosensitive layer; λ represents a wavelength of the light used for image writing; and m is an integer. This is because the light is strengthened by the interference when such a relationship is satisfied. For example, when λ is 780 nm and n is 2.0, a pair of a dark line image and a light line image are generated when the thickness of the photosensitive layer varies by 0.195 μm. It is hard to control the thickness variation in the entire photosensitive layer within 0.195 μm. Therefore, in attempting to solve the undesired stripe image problem, the following methods have been proposed:

(1) Japanese Laid-Open Patent Publication No. 57-165845 discloses a photoreceptor which includes an aluminum substrate and amorphous silicon formed thereon and serving as a charge generation layer, wherein a light absorbing layer is formed on the aluminum substrate to avoid specular reflection on the surface of the aluminum substrate. This method is effective for a photoreceptor having a layer structure in which a charge transport layer and a charge generation layer (an amorphous silicon layer) are formed on an aluminum substrate in this order. However, the method is hardly effective for a photoreceptor, which is typically used for electrophotographic image forming apparatus and which has a layer structure in which a charge generation layer (an amorphous silicon layer) and a charge transport layer are formed on an aluminum substrate in this order.

(2) Japanese Laid-Open Patent Publication No. 7-295269 discloses a photoreceptor which has a layer structure in which an undercoat layer, a charge generation layer and a charge transport layer are formed on an aluminum substrate in this order, wherein a light absorbing layer is formed on the aluminum substrate. However, this method cannot perfectly prevent the occurrence of the undesired stripe image.

(3) Japanese Patent Publication No. 7-27262 discloses an image forming apparatus which includes a photoreceptor including a cylindrical substrate having a cross section in which a main peak is overlapped with a sub-peak when the substrate is cut along a plane including the central axis of the cylindrical substrate. The apparatus has a light irradiator which irradiates the photoreceptor with coherent light beam whose diameter is less than the one cycle of the main peak, to form a latent image. This image forming apparatus can prevent the occurrence of the undesired stripe image when a limited photoreceptor is used. However, there are many photoreceptors which have such a substrate but which produce undesired stripe images even when used for the image forming apparatus.

(4) Japanese Laid-Open Patent Publication No. 10-301311 discloses a photoreceptor whose surface has a Arithmetical Mean Deviation of the Profile (Ra) (defined in JIS B0601), wherein the Ra is not less than the wavelength of the light used for image writing. When the formed image has a low resolution or the light used for image writing has a relatively large diameter, the occurrence of the undesired stripe image can be almost prevented by this method. However, when the diameter of the light becomes small to record images having high resolution, the undesired stripe image is often generated. It can be said that the method of controlling the surface roughness of a substrate in view of Ra is effective only for substrates whose surface is represented by a wave which has a similar amplitude. However, such substrates are rare, and almost all the substrates have a surface represented by a wave in which plural waves having different amplitudes and different wavelengths are overlapped with each other. Ra is not proper for representing the roughness of such substrates because the waves other than the waves having a relatively large amplitude are cancelled when Ra of a profile is measured.

The surface roughness of a substrate can be represented by another parameter such as Ry (maximum height) and Rz (ten-point mean roughness) defined JIS B0601. However, even when the surface roughness of a substrate is controlled by controlling such parameters, the occurrence of the undesired stripe images cannot be perfectly avoided. In particular, when the diameter of the light used for image writing becomes small to obtain high resolution images, the undesired stripe images are often produced.

Because of these reasons, a need exists for an image forming apparatus using a photoreceptor, which can produce good images without an undesired stripe image caused by specular reflection in the photoreceptor.

SUMMARY OF THE INVENTION

Accordingly, an object of the present invention is to provide an image forming method and apparatus using a photoreceptor, which can produce good images without an undesired stripe image caused by specular reflection in the photoreceptor.

Another object of the present invention is to provide a photoreceptor which can produce good images without an undesired stripe image caused by specular reflection therein.

Briefly these objects and other objects of the present invention as hereinafter will become more readily apparent can be attained by an image forming apparatus including a photoreceptor having a photosensitive layer overlying an electroconductive substrate and a light irradiator configured to irradiate the photoreceptor with coherent light having a wavelength λ represented in units of micrometers and a diameter ϕ represented in units of micrometers, wherein a maximum height in a part of the profile of the lower surface (i.e., the surface closer to the substrate) of the photosensitive layer in a sampling range of $\phi$ is not less than $\lambda/(2n)$, where n is a refractive index of the photosensitive layer at the wavelength $\lambda$.

The photoreceptor may include an undercoat layer between the photosensitive layer and the substrate. In this case, the profile of the upper surface of the undercoat layer has the property mentioned above.

Alternatively, a maximum height in any part of the profile of the surface of the substrate is not less than $\{\lambda/(2n)\}\times 1.03$ in a sampling range of $\phi$. In this case, an undercoat layer maybe formed between the photosensitive layer and the substrate, which preferably has a thickness not greater than 15 $\mu$m.

The diameter of the coherent light is preferably not greater than $\lambda$ $\mu$m.

The refractive index of the photosensitive layer is preferably from 1.2 to 2.0 when measured by the light having a wavelength of $\lambda$ $\mu$m.

The image forming apparatus may further include a charger which charges the photoreceptor before writing the latent image, an image developer having plural developing station each including a different color developer. The color image forming apparatus may have plural photoreceptors for forming a different color image thereon. In addition, the color image forming apparatus preferably has an intermediate transfer belt on which different color images are transferred from the photoreceptor or photoreceptors to form a color image. The color image is then transferred onto a receiving material.

In another aspect of the present invention, a photoreceptor is provided which is used for an image forming apparatus and which includes a photosensitive layer located on an electroconductive substrate, wherein a maximum height of a part of the profile of the lower surface of the photosensitive layer is not less than $\lambda/(2n)$ in a sampling range of $\phi$, wherein $\phi$ and $\lambda$ represent the diameter ($\mu$m) and wavelength ($\mu$m) of light used for image writing and n is the refractive index of the photosensitive layer at the wavelength $\lambda$.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
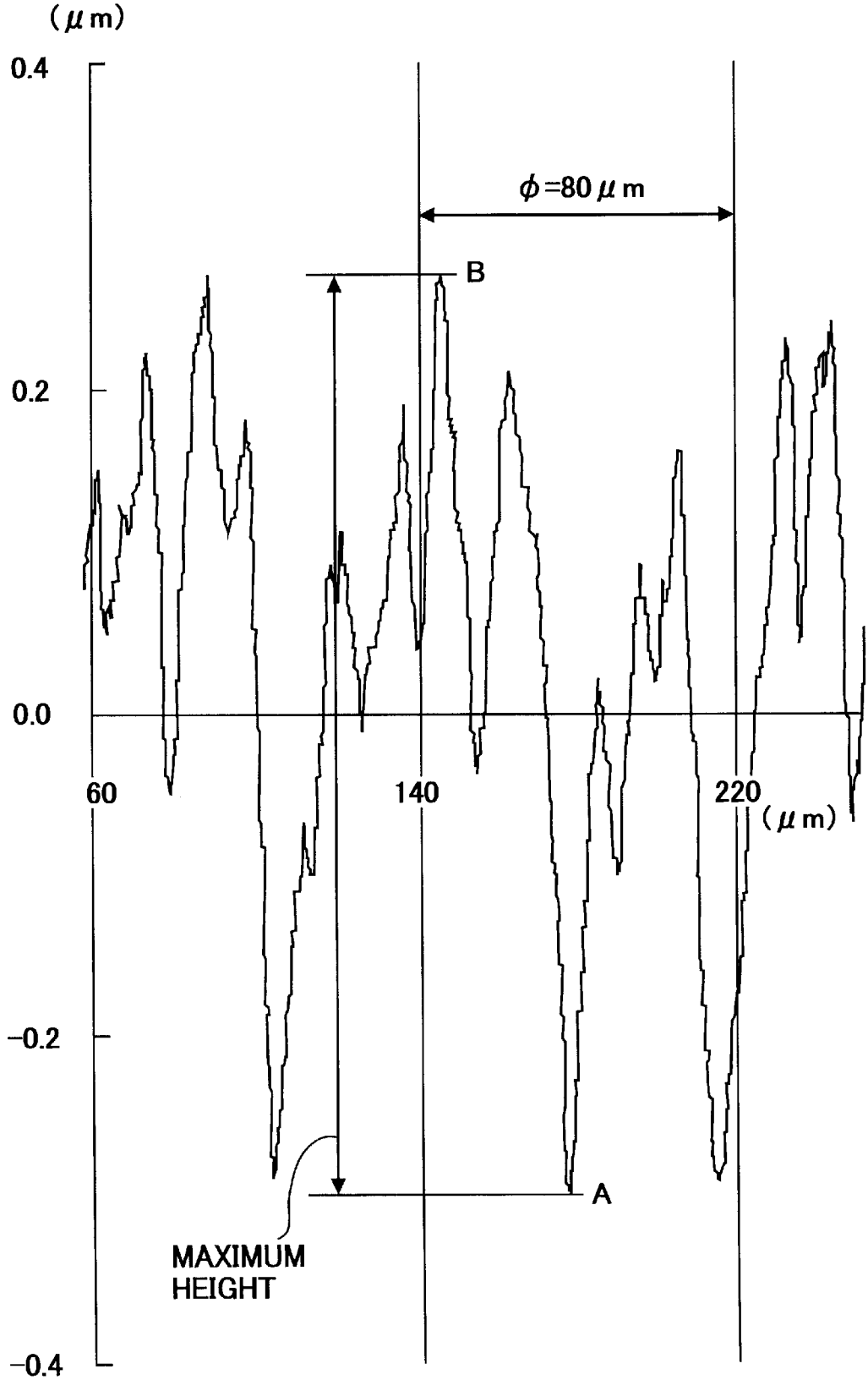
FIG. 1 is a schematic view used for explaining the maximum height of a profile of the lower surface of a photosensitive layer.

The present inventors have carefully observed various image forming apparatus to examine the photoreceptors which produced images with undesired stripe images and the photoreceptors which produced images without the undesired stripe images. As a result thereof, it is found that there might be a relationship between the surface conditions of the substrates used for the photoreceptors and the occurrence of the undesired stripe images. However, the occurrence of the undesired stripe images does not relate to the parameters representing the surface roughness of the substrate, such as Ry (maximum height), Rz (ten-point mean roughness) and Ra (Arithmetical Mean Deviation of the Profile), which are defined in Japanese Industrial Standard (i.e., JIS B0601).

The undesired stripe images produced in electrophotographic image forming methods, which are caused by specular reflection in the photoreceptor used therein, are due to uneven density of the pixels constituting the images. If specular reflection occurs in each pixel, it is considered that the whole image only changes its image density level. When a pixel is small, the undesired stripe image in the pixel cannot be observed by naked eyes. Therefore, the present inventors discover that it is important to actively generate the stripe image in each pixel. Namely, by forming fine asperities on a substrate (i.e., by forming fine asperities on a surface of a photosensitive layer, which surface contacts the substrate), fine stripe images, which cannot be observed by naked eyes, are actively generated.

In other words, it is preferable that even when there are asperities on the surface of the substrate, visible undesired stripe images are not formed if the light beam used for image writing can be strengthened by interference at a position (hereinafter referred to as light strengthening position) in a pixel and weakened in another position (hereinafter referred to as a light weakening position) of the pixel.

If there is only the light strengthening position in a pixel, the strength of the light in the pixel is relatively large compared to the pixel having both the light strengthening position and light weakening position. Therefore, the image density of the pixel is high.

To the contrary, if there is only the light weakening position in a pixel, the strength of the light in the pixel is relatively low compared to the pixel having both the light strengthening position and light weakening position. Therefore, the image density of the pixel is low.

When such image density variation is caused by the variation of the thickness of the photosensitive layer, the image has visible undesired stripe images.

When both the light strengthening position and the light weakening position are present in a pixel, the image density is averaged and observed as the normal image density because the pixel is so small.

In the present invention, an image forming apparatus is provided in which light having a wavelength of $\lambda$ ($\mu$m) and a spot diameter of $\phi$ ($\mu$m) irradiates a photoreceptor to write a latent image on the photoreceptor, wherein the photoreceptor includes a photosensitive layer overlying an electroconductive substrate, wherein a maximum height of the profile of the lower surface of the photosensitive layer is not less than $\lambda/(2n)$ in a sampling range of $\phi$, wherein n is the refractive index of the photosensitive layer when measured using the light having a wavelength of $\lambda$.

FIG. 1 is an embodiment of the profile (i.e., the cross-sectional curve) of the lower surface of a photosensitive layer in a photoreceptor, which surface contacts a substrate, (hereinafter the surface is sometimes referred to as an interface between the photosensitive layer and the substrate or a lower surface). In this case, the diameter $\phi$ of the light for image writing is 80 $\mu$m. In FIG. 1, the maximum height is represented by $|B-A|$. By changing a measuring (i.e., sampling) point, the maximum height in any position of the image forming area can be obtained.

In the photoreceptor of the present invention, the maximum height of the profile of the lower surface of the photosensitive layer in the image forming area of the photoreceptor is not less than $\lambda/(2n)$, preferably not less than $\{\lambda/(2n)\}\times1.05$, and more preferably greater than $\{\lambda/(2n)\}\times1.10$. The greater the maximum height, the better the evenness of the resultant images (i.e., the less the undesired stripe images). However, the maximum height is too large, a short circuit tends to occur when charging the photoreceptor, which is caused by projections of the substrate. Therefore another undesired image is formed. In addition, when forming a photosensitive layer by coating a coating liquid, the coating liquid tends to aggregate near the projections, resulting in formation of another undesired image. Therefore, the maximum height is not greater than 3.0 $\mu$m, preferably not greater than 2.7 $\mu$m and more preferably not greater than 2.0 $\mu$m.

The photoreceptor of the present invention has an electroconductive substrate, and at least a photosensitive layer is formed on the substrate. Optionally an under coat layer and the like layer is formed between the photosensitive layer and the substrate. The photosensitive layer may be a multi-layer type photosensitive layer including a charge generation layer and a charge transport layer, or a single-layer type photosensitive layer including a charge generation material and a charge transport material.

In single-layer type photosensitive layer, n represents the refraction index of the photosensitive layer. In multi-layer type photosensitive layer, n represents the refraction index of the charge transport layer. When a charge generation layer is formed on the substrate and then a charge transport layer is formed thereon, the profile of the interface between the charge generation layer and the substrate should be analyzed. However, the charge generation layer is typically very thin, and in addition the charge generation layer and charge transport layer are typically mixed with each other. Therefore, the profile of the interface between the photosensitive layer and the substrate may be analyzed.

When the photoreceptor of the present invention has an undercoat layer between the substrate and the photosensitive layer, the surface of the undercoat layer (i.e., the interface between the undercoat layer and the photosensitive layer) may be analyzed unless the undercoat layer is deformed by being dissolved or swelled by the photosensitive layer coating liquid to be coated thereon.

When the photoreceptor of the present invention has a substrate which is not dissolved or swelled by a photosensitive layer coating liquid to be coated thereon, the surface of the substrate may be analyzed.

In order to control the surface roughness of the interface between the photosensitive layer and the undercoat layer in the range mentioned above, the following methods can be used:

(1) the undercoat layer is polished or sandblasted (physical treatments);
(2) the undercoat layer is subjected to an electric or electrochemical treatment;
(3) the undercoat layer is subjected to a heat treatment;
(4) the undercoat layer is contacted with a solvent to dissolve and remove a component included therein, resulting in formation recesses in the undercoat layer;
(5) a particulate material is included in the undercoat layer; and
(6) coating and drying conditions are controlled when forming the undercoat layer.

Among these methods, the undercoat layer including a particulate material is preferably used because of having good reproducibility of the rough surface. In addition, it is preferable to form the undercoat layer by a spray coating method because the resultant undercoat layer has a proper surface roughness.

In addition, it is important to control the surface conditions of the substrate. Even when an undercoat layer is formed on a substrate, the surface of the undercoat layer is influenced by the surface conditions of the substrate.

The surface conditions of the substrate can be controlled by the following methods:

(1) the substrate is subjected to a mechanical treatment such as polishing, cutting, sandblasting, and honing;
(2) the substrate is subjected to an electric or electrochemical treatment; and
(3) a particulate material is included in the surface of the substrate.

The surface treatment using cutting is easy, and the surface roughness can be changed in a wide range. However, the cutting tools used for cutting tend to be easily abraded, and therefore the cutting tools have to be properly controlled to control the surface roughness of the substrate.

In the photoreceptor of the present invention, the maximum height of the surface of the substrate corresponding to the image forming area of the photoreceptor is preferably greater than $\{\lambda/(2n)\}\times1.03$, more preferably greater than $\{\lambda/(2n)\}\times1.07$, and even more preferably greater than $\{\lambda/(2n)\}\times1.12$.

When the maximum height is less than $\{\lambda/(2n)\}\times1.03$, there is a possibility that the surface has a portion in which the maximum height is less than $\{\lambda/(2n)\}$, and thereby it is possible that a small undesired stripe image is produced.

The thickness of the undercoat layer is not greater than 14 $\mu$m, preferably not greater than 12 $\mu$m, and more preferably from 0.5 $\mu$m to 10 $\mu$m. When the undercoat layer is too thick, the surface of the substrate has little effect on preventing undesired stripe images even when the surface has been subjected to a treatment because the surface of the undercoat layer is too smooth, resulting in formation of the undesired stripe images.

The diameter $\phi$ of the light used for image writing means the diameter of the light spot. When the spot has an ellipse shape, it is preferable that the minor axis of the ellipse is considered to be the spot diameter $\phi$ to produce good images.

The direction of the photoreceptor, along which the profile of the interface between the photosensitive layer and the undercoat layer (or the substrate) is to be analyzed, is not particularly limited. However, it is preferable that the direction is the same as the direction of the light spot toward which the spot diameter $\phi$ is measured.

Figure 2:
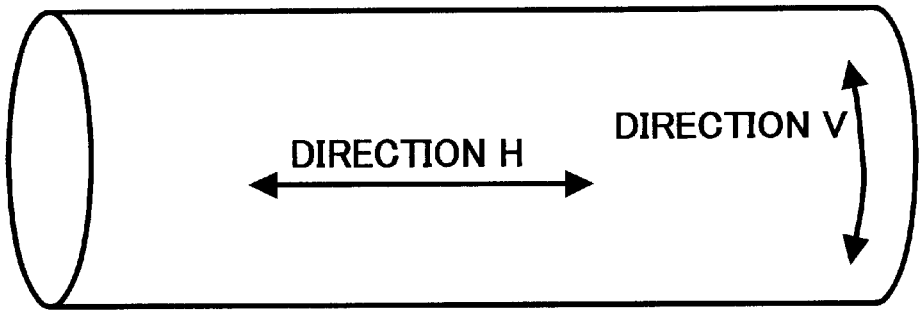
FIGS. 2 and 3 are schematic views used for explaining the scanning direction when measuring the maximum height of a profile of the lower surface of a photosensitive layer in cylindrical and belt photoreceptors.
Figure 3:
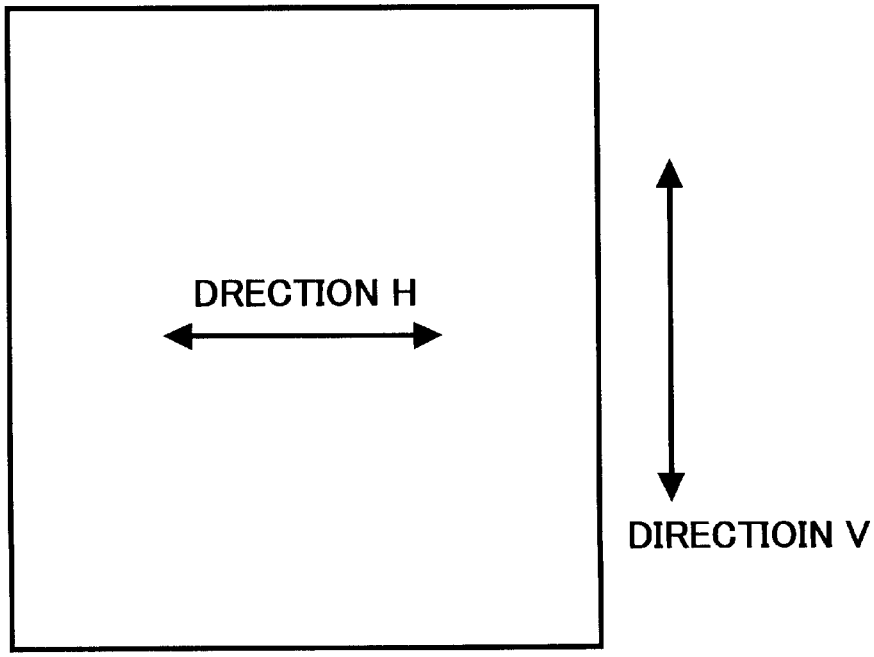

In many image forming systems, the spot of the light used for image writing is arranged such that the direction of the major axis of the spot is the same as the moving direction V of the photoreceptor as shown in FIGS. 2 and 3, which illustrate a cylindrical photoreceptor and a belt shaped photoreceptor, respectively. Therefore, it is preferable that the profile of the interface between the photosensitive layer and the undercoat layer (or the substrate) is analyzed in the direction H.

The method for obtaining the profile of the lower surface of the photosensitive layer includes physical methods, optical methods, electrical methods and electrochemical methods, but is not limited thereto. However, the physical and optical methods are preferable in view of resolution and repeatability. In particular, physical methods using a sensing pin (i.e., stylus methods) are preferable in view of repeatability. With respect to the area to be measured, it is preferable to measure the entire image forming area of a photoreceptor. However, the variation of the profile is small in the image forming area, it is sufficient to obtain the profile of the center surface of the substrate or the profiles of the several points of the substrate, which points are present under the image forming area of the photosensitive layer, if the measuring length (i.e., the scanning length) is sufficiently long. The measuring length is preferably not shorter than the unit length defined in JIS 94 (i.e., JIS B0601-1994) and 10 $\phi$.

The refractive index n of the photosensitive layer changes depending on not only the materials used and manufacturing method of the photosensitive layer, but also the wavelength of the light used for image writing. The refractive index n of the photosensitive layer is from 1.2 to 3.0, preferably from 1.3 to 2.5 and more preferably from 1.4 to 2.2. When n is too small, it is difficult to form sharp images. To the contrary, when n is too large, the photosensitivity of the resultant photoreceptor decreases.

The diameter $\phi$ of the light spot used for writing images is not particularly limited in the present invention if the resultant images have the desired resolution. However, the diameter is preferably not greater than 60 $\mu$m, and more preferably not greater than 50 $\mu$m to form images having high resolution. The photosensitive layer is formed such that the maximum height in any range having a length 0 of the profile of the lower surface of the photosensitive layer is greater than $\lambda/(2n)$.

When the diameter $\phi$ of the light spot becomes small, the maximum height in a sampling range having a length $\phi$ becomes small. In particular, at a point near a projected area or a recessed area of a profile, the maximum height tends to become small. In other words, even when the same photosensitive layer is used, the undesired stripe images tend to be produced if the diameter of the light spot becomes small.

In the image forming apparatus of the present invention, one light beam or plural light beams can be used for writing latent images. However, plural light beams are preferably used in view of image forming speed. When plural light beams are used, the edge of a light beam tends to overlap with the neighboring light beam, and thereby the undesired stripe images tend to be produced. Therefore, the profile of the lower surface of the photosensitive layer should be properly controlled.

Suitable materials for use as the electroconductive substrate of the photoreceptor of the present invention include drums or belts made of a metal such as copper, aluminum, gold, silver, platinum, palladium, and nickel or a metal alloy thereof; and plastic films on which a layer of the metals mentioned above or electroconductive oxides such as tin oxide and indium oxide is formed by a vacuum evaporation method, a chemical plating method or the like.

As the undercoat layer of the photoreceptor of the present invention, a resin layer; a layer mainly including a white pigment and a resin; and a metal oxide layer which is formed by chemically or electrochemically oxidizing the surface of the electroconductive substrate, can be used. Among these layers, the layer mainly including a white pigment and a resin is preferable.

Specific examples of the white pigments include metal oxides such as titanium oxide, aluminum oxide, zirconium oxide and zinc oxide. Among these metal oxides, titanium oxide is preferable because injection of charges from the substrate can be effectively prevented.

Specific examples of the resins for use in the undercoat layer include thermoplastic resins such as polyamide resins, polyvinyl alcohol resins, casein, and methyl cellulose; thermosetting resins such as acrylic resins, phenolic resins, melamine resins, alkyd resins, unsaturated polyester resins, and epoxy resins; and their mixtures.

Specific examples of the charge generation materials for use in the charge generation layer and the single layer type photosensitive layer include organic pigments and dyes such as monoazo pigments, bisazo pigments, trisazo pigments, tetrakisazo pigments, triarylmethane dyes, thiazine dyes, oxazine dyes, xanthene dyes, cyanine dyes, styryl dyes, pyrylium dyes, quinacridone pigments, indigo pigments, perylene pigments, polycyclic quinone pigments, benzimidazole pigments, indanthrene pigments, squarilium pigments, and phthalocyanine pigments; inorganic materials such as selenium, selenium-arsenic alloy, selenium-tellurium alloy, cadmium sulfide, zinc oxide, titanium oxide, and amorphous silicon.

The charge generation layer is typically constituted of one or more of these charge generation materials which are dispersed in a binder resin.

Specific examples of the charge transport material for use in the charge transport layer and the single layer type photosensitive layer include anthrathene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine compounds, phenylenediamine derivatives, aminostilbene derivatives, triphenylamine derivatives, phenylenediamine derivatives, aminostilbene derivatives and triphenylmethane derivatives. These materials can be used alone or in combination.

Suitable resins for use as the binder resin for use in the charge generation layer, charge transport layer and a single layer type photosensitive layer preferably include electrically insulating resins such as thermoplastic resins, thermosetting resins, photo-crosslinking resins and photoconductive resins.

Specific examples of such resins include thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyester resins, phenoxy resins, (meth)acrylic resins, polystyrene, polycarbonate, polyarylate, polysulfone, polyethersulfone, and ABS resins; thermosetting resins such as phenolic resins, epoxy resins, urethane resins, melamine resins, isocyanate resins, alkyd resins, silicone resins, thermosetting acrylic resins; and photoconductive resins such as polyvinyl carbazole, polyvinyl anthracene, and polyvinyl pyrene.

These resins can be used alone or in combination. The binder resin is not limited thereto.

The image forming apparatus of the present invention is used for image forming apparatus such as copiers, printers and facsimile machines.

The density of the latent image formed on the photoreceptor is not limited. However, the density is preferably not less than 1000 dpi (dots per inch), and more preferably not less than 1200 dpi to produce images having good image qualities. When such high density images are produced, the information (e.g., variation of charging ability and photosensitivity) specific to the photoreceptor used tends to be overlapped with the written images and therefore undesired stripe image tends to be produced in conventional image forming apparatus. However, the undesired stripe image is hardly produced in the image forming apparatus of the present invention.

The wavelength $\lambda$ of the light used for image writing is not particularly limited. However, the wavelength is preferably not greater than 700 nm, more preferably not greater than 675 nm, and even more preferably from 400 to 600 nm to form high density images. Even when such short wavelength light is used for writing images, the image forming apparatus can produce high resolution images without producing the undesired stripe image.

The method for reproducing half tone images is not particularly limited in the present invention. In the multivalue type methods for reproducing half tone image, the image densities of the pixels are set at many levels and therefore, the undesired stripe image tends to be produced by conventional photoreceptors. In particular, when a pulse modulation, a power modulation or a combination thereof is used, the undesired stripe image is often produced. However, even when using such a multivalue type method, the undesired stripe image is hardly produced in the image forming apparatus of the present invention.

The image forming apparatus of the present invention can be used for producing monochrome images, multi-color images or full color images without producing the undesired stripe image. In general, multi-color images and full color images are needed to have higher image qualities than monochrome images. When plural color images are overlaid to form a color image, the undesired stripe image of each color image is overlapped, and therefore the stripe image is emphasized. By using the image forming apparatus of the present invention, high quality color images can be produced without producing the undesired stripe image.

In the image forming method and apparatus, the following color forming methods can be used:

(1) a color image formed on a photoreceptor is transferred on a receiving material such as paper and the process is repeated plural times using different color toners to form a full color image (or a multi-color image) on the receiving material;

(2) color images formed on respective photoreceptors are transferred on a receiving material one by one to form a full color image (or a multi-color image) thereon;

(3) a color image formed on a photoreceptor is transferred on an intermediate transfer medium and the process is repeated plural times using different color toners to form a full color image on the intermediate transfer medium, and then the full color image (or a multi-color image) is transferred on a receiving material; and (4) color images formed on respective photoreceptors are transferred on an intermediate transfer medium one by one to form a full color image (or a multi-color image) thereon, and the full color image is transferred on a receiving material.

Among these color image forming methods, the methods using an intermediate transfer medium are preferable because high density images having good positional preciseness can be formed. In addition, the methods have an advantage such that the intermediate transfer medium can elastically touch a receiving material, and thereby the resultant full color image formed on the intermediate transfer medium can be effectively transferred on the receiving material.

Next, the image forming apparatus and method of the present invention will be explained referring to drawings.

Figure 11:
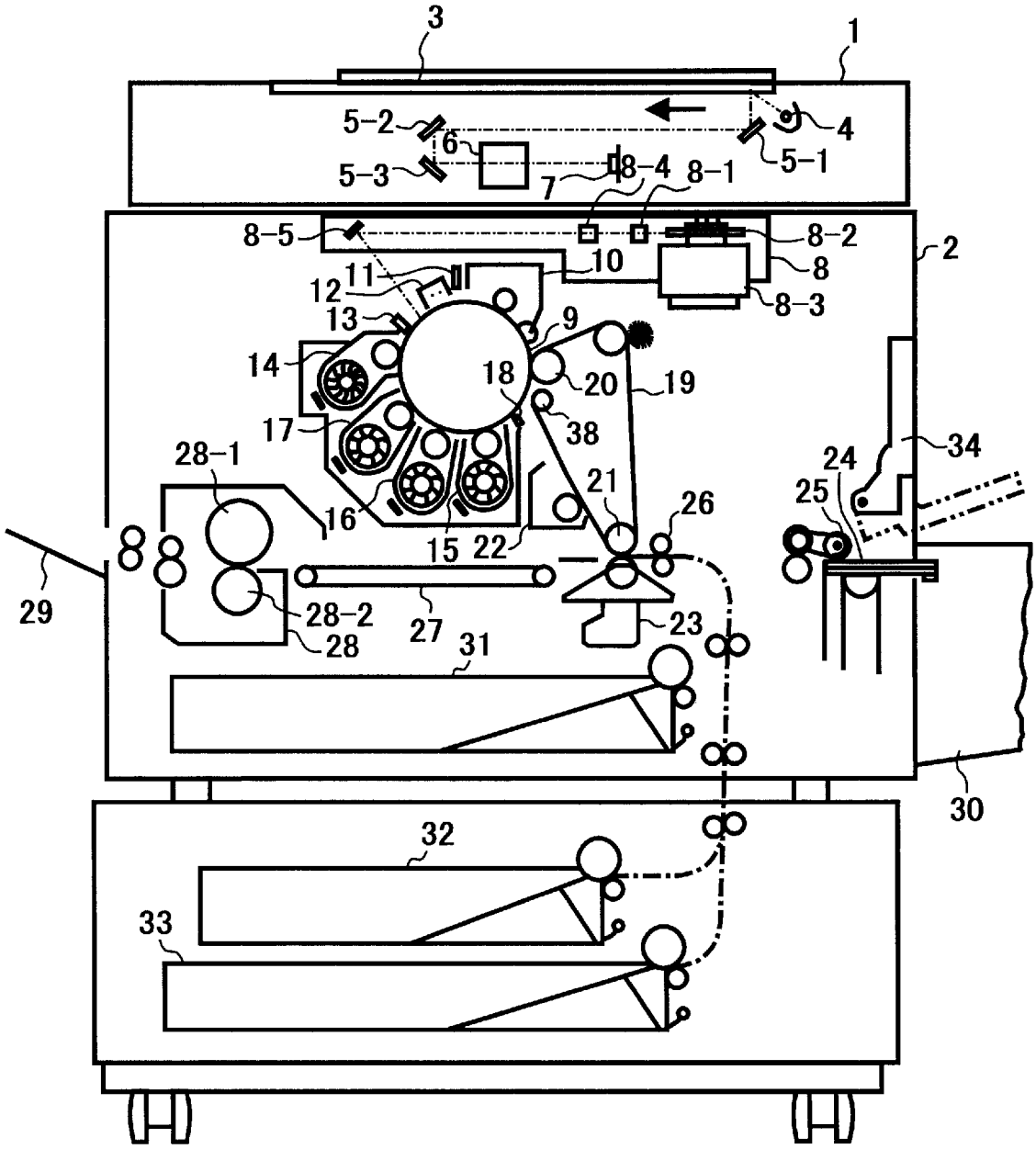
FIGS. 11 and 12 are views illustrating the whole structure and partial structure of an embodiment of the image forming apparatus of the present invention.

FIG. 11 is a schematic view illustrating the whole structure of a color copier which is an embodiment of the image forming apparatus of the present invention. The color copier has an endless belt which serves as the intermediate transfer medium.

Figure 12:
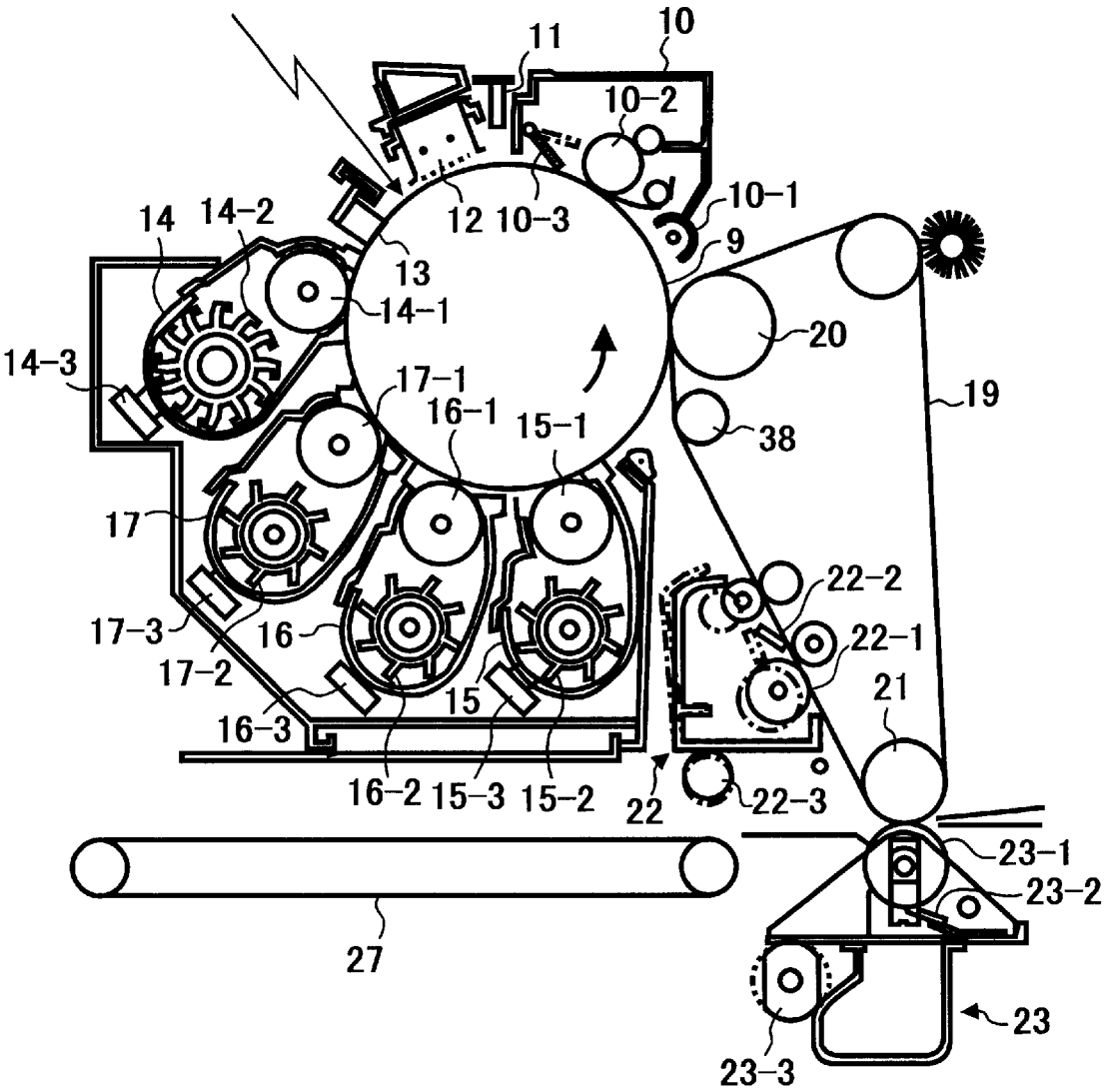

FIG. 12 is an enlarged view illustrating the structure around the photoreceptor of the color copier shown in FIG. 11.

The color copier is constructed of a color image reading device 1 and a color printer 2. The color image reading device 1 (hereinafter referred to as the color scanner 1) includes a lamp 4 irradiating an original 3 with light, mirrors 5-1, 5-2, and 5-3, and lens 6 to focus the image of the original 3 on a sensor 7. The color information of the image is read while separating the image into, for example, a blue image (B), a green image (G) and a red image (R). The read color images are then converted to image signals. In the color scanner 1, the thus obtained B, G and R are subjected to a color changing process in an image processor (not shown) according to the signal strength thereof. Thus, color image data of a black image (BK), a cyan image (C), a magenta image (M) and a yellow image (Y) can be prepared. As described in detail below, the color images data are visualized using BK, C, M and Y toners, and then these toner images are overlaid, resulting in formation of a full color image.

Next, the color printer 2 will be explained in detail. In FIG. 1, an image writing optical unit 8 writes image information on a photoreceptor drum 9 according to the color image data of the original image sent by the color scanner 1. In the image writing optical unit 8, laser beams emitted by a laser source 8-1 are scanned by a polygon mirror 8-2 driven by a driving motor 8-3. The laser beams, which pass through an fθ lens 8-4 and a reflecting mirror 8-5, irradiate the surface of the photoreceptor drum 9 to form a latent image thereon.

The photoreceptor drum 9 rotates in the counterclockwise direction indicated by an arrow. Around the photoreceptor drum 9, a cleaning unit which includes a pre-cleaning discharger and which cleans the surface of the photoreceptor drum 9; a discharge lamp 11 which discharges charges remaining on the photoreceptor drum 9; a charger 12 which charges the photoreceptor drum 9; a potential sensor 13; a BK image developer 14; a C image developer 15; an M image developer 16; a Y image developer 17; a developing density pattern detector 18; an intermediate transfer medium 19; and a pre-transfer discharger 35 are arranged.

As shown in FIG. 12, each image developer 14, 15, 16 or 17 is constructed of a developing sleeve (14-1, 15-1, 16-1 or 17-1) which rotates to carry a developer such that the developer faces the photoreceptor drum 9, a paddle (14-2, 15-2, 16-2 or 17-2) which rotates to scoop up and agitate the developer, and a toner concentration detecting sensor (14-3, 15-3, 16-3 or 17-3) which detects the toner concentration in each developer.

Then the image forming process will be explained in detail when BK, C, M and Y images are formed in this order. The developing order is not limited thereto.

When a coping operation is started, laser beams irradiate the photoreceptor drum 9 according to the BK image data read by the color scanner 1 to form a BK latent image thereon. The developing sleeve 14-1 starts to rotate before the tip of the BK latent image reaches the developing position in the BK image developer 14 to develop the BK latent image with the BK toner. This developing operation is continued until the rear end of the BK latent image passes the developing position. The BK image developer 14 achieves a dormant state before the C developing operation is started.

The BK toner image formed on the photoreceptor drum 9 is transferred onto an intermediate transfer belt 19 which is fed at the same speed as that of the photoreceptor drum 9. Hereinafter this toner transfer is referred to as the belt transfer. The belt transfer is performed while the photoreceptor drum 9 is contacted with the intermediate transfer belt 19 and a predetermined bias voltage is applied to a transfer bias roller 20. Similar to the BK belt transfer, C, M and Y belt transfers are performed such that the BK, C, M and Y toner images (i.e., a full color image) are formed on the proper positions of the intermediate transfer belt 19. All of the thus prepared four color images are then transferred onto a receiving paper at once. Thus a full color image is formed on the receiving paper.

The construction and operation of the intermediate transfer belt 19 will be explained later in detail.

In the photoreceptor drum 9, the BK image forming process is followed by a C image forming process. The laser beams irradiate the photoreceptor drum 9 according to the C image data read by the color scanner 1 to form a C latent image thereon. The developing sleeve 15-1 starts to rotate to elect the C developer after the rear end of the BK latent image passes the developing position in the C image developer 15 and before the tip of the C latent image reaches the developing position. Thus, the C latent image is developed with the C toner. This C developing operation is continued until the rear end of the C latent image passes the C developing position. Similarly to the BK developing operation, the C image developer 15 achieves a dormant state (i.e., the ears of the C developer are laid) before the M developing operation is started.

The M and Y image developing operations are performed in the similar way as performed in the BK and C image developing operations.

Then the intermediate transfer belt unit will be explained in detail.

The intermediate transfer belt 19 bears the BK, C, M and Y images thereon, and is tightened by a drive roller 21, a belt transfer bias roller 20, a grounded transfer roller 38 and driven rollers. The intermediate transfer belt 19 is driven by a stepping motor (not shown) as explained later in detail.

As shown in FIG. 12, a belt cleaning unit 22 is constituted of a brush roller 22-1, a rubber blade 22-2, and a touch/detach mechanism 22-3. After the BK image is transferred onto the intermediate transfer belt 19, the belt cleaning unit 22 can be detached from the intermediate transfer belt 19 during the C, M and Y belt transfers.

A paper transfer unit 23 is constituted of a paper transfer bias roller 23-1, a roller cleaning blade 23-2, and a belt touch/detach mechanism 23-3. The bias roller 23-1 is ordinarily separated from the intermediate transfer belt 19. When the four color images (i.e., the full color image) formed on the intermediate transfer belt 19 are transferred at once, the receiving paper is timely pressed by the belt touch/detach mechanism 23-3 to transfer the color images onto the proper position of the receiving paper while a bias voltage is applied to the receiving paper.

As shown in FIG. 11, the receiving paper 24 is timely fed by a feed roller 25, and a registration roller 26 such that the four color images on the belt 19 can be transferred onto the proper position of the receiving paper 24.

After the belt transfer of the entire BK toner image is completed, the operation of the belt 19 is selected from the following operations:

(1) Constant Speed Forwarding Operation

In this operation, after the first BK color image is transferred, the belt 19 continues to be forwarded at a constant speed. In this case, the second, third and fourth color toner images are timely formed on the photoreceptor drum 9 such that the color images are transferred onto the proper position of the belt 19, resulting in formation of a full color image thereon.

In detailed description, the belt 19 continues to be forwarded at a constant speed after the BK color image is transferred thereon. The C image is timely formed on the photoreceptor drum 9 such that the C image is transferred on the proper position of the BK image on the belt 19 forwarded at a constant speed. Similarly to this operation, the M and Y images are also transferred onto the BK and C color images on the belt 19, resulting in formation of a full color image on the belt 19. The belt 19 continues to be forwarded and the full color image thereon is transferred onto the receiving paper 24 at once as mentioned above.

(2) Skip Forwarding Operation

In this operation, after the first BK color image is transferred onto the belt 19, the belt 19 is separated from the photoreceptor 9 and forwarded at a speed higher than ever. After the belt 19 is forwarded at the higher speed for a predetermined distance, the speed of the belt 19 is changed to the former speed and then the belt 19 is again contacted with the photoreceptor drum 9. This method is effective for the case in which the length of the belt 19 is much longer than that of the formed image, and thereby the increase of the image forming cycle time can be prevented.

In detailed description, after the BK color image is transferred onto the belt 19, the belt 19 is separated from the photoreceptor 9 and forwarded at a speed higher than ever. After the belt 19 is forwarded at the higher speed for a predetermined distance, the speed of the belt 19 is changed to the former speed and then the belt 19 is again contacted with the photoreceptor drum 9.

The C image is timely formed on the photoreceptor drum 9 such that the C image is transferred onto the proper position of the belt 19 on which the BK image has been formed. Similarly to this operation, the M and Y images are also transferred onto the BK and C color images on the belt 19, resulting in formation of a full color image on the belt 19. The full color image on the belt 19 is transferred onto the receiving paper 24 at once while the belt 19 is forwarded without changing the speed.

(3) Quick Return Operation

In this operation, after the first BK color image is transferred onto the belt 19, the belt 19 is separated from the photoreceptor 9 and returned to the home position at a speed higher than ever to wait for the next belt transfer. This operation is controlled more easily than the operations (1)

and (2) because the moving distance of the belt 19 is smaller than the operations (1) and (2).

In detailed description, after the BK image is transferred onto the belt 19, the belt 19 is separated from the photoreceptor 9 and returned to the home position at a speed higher than ever. The returning operation is performed until the belt 19 reaches its home position after the tip of the BK image passes the transfer position. Then the belt 19 is stopped at the home position to wait for the next belt transfer.

The tip of the C image on the photoreceptor 9 reaches a predetermined point before the transfer position, the belt 19 timely starts to be forwarded to transfer the C image on the proper position of the belt 19. Similarly to this operation, the M and Y images are transferred onto the proper position of the belt 19, resulting in formation of a full color image on the belt 19. Then the belt 19 is forwarded without being returned to transfer the full color image onto the receiving paper 24.

In FIG. 11, the receiving paper 24 on which four color images (i.e., a full color image) are transferred is fed by a paper feeding unit 27 to a fixer 28. In the fixer 28, the color images on the receiving paper 24 are fixed at a nip of a fixing roller 28-1 which is controlled so as to have a predetermined temperature, and a pressure roller 28-2. The receiving paper 24 having the color images (i.e., a full color copy) is then fed to the copy tray 29.

After the belt transfer, the photoreceptor drum 9 is cleaned by a photoreceptor cleaning unit 10, which has a pre-cleaning discharger 10-1, a brush roller 10-2 and a rubber blade 10-3, and is then discharged uniformly by a discharge lamp 11.

After transferring the color toner images onto the receiving paper 24, the belt 19 is cleaned by the cleaning unit 22 which is again contacted to the belt 19 by the touch/detach mechanism 22-3. When repeating the copy, the BK image forming process of the second copy is timely performed after the Y image forming process of the first copy. On the cleaned area of the belt 19, the BK image of the second copy is transferred. The C, M and Y images of the second copy are also transferred onto the belt 19 in the same way as performed for the first copy.

As shown in FIG. 11, various sizes of papers are set in paper cassettes 30, 31, 32 and 33. The paper specified by the operation panel (not shown) is fed toward the registration roller 26 from its cassette. Numeral 34 denotes a manual paper feed tray from which an OHP film, a thick paper or the like receiving sheet is manually fed.

If desired, three color images or two color images can be also produced in the same way as that mentioned above for four color images except that three or two of the image forming operations are performed. When monocolor copies are produced, only the image developer 14, 15, 16 or 17 achieves an active state (i.e., the ear of the developer is elected) until the copies are completed. The belt 19 is forwarded at a constant speed while contacting the surface of the photoreceptor drum 19. In addition, the copy operation is performed while the belt cleaner 22 contacts the belt 19.

Next another embodiment of the image forming apparatus and method of the present invention will be explained referring to FIGS. 13 and 14.

Figure 13:
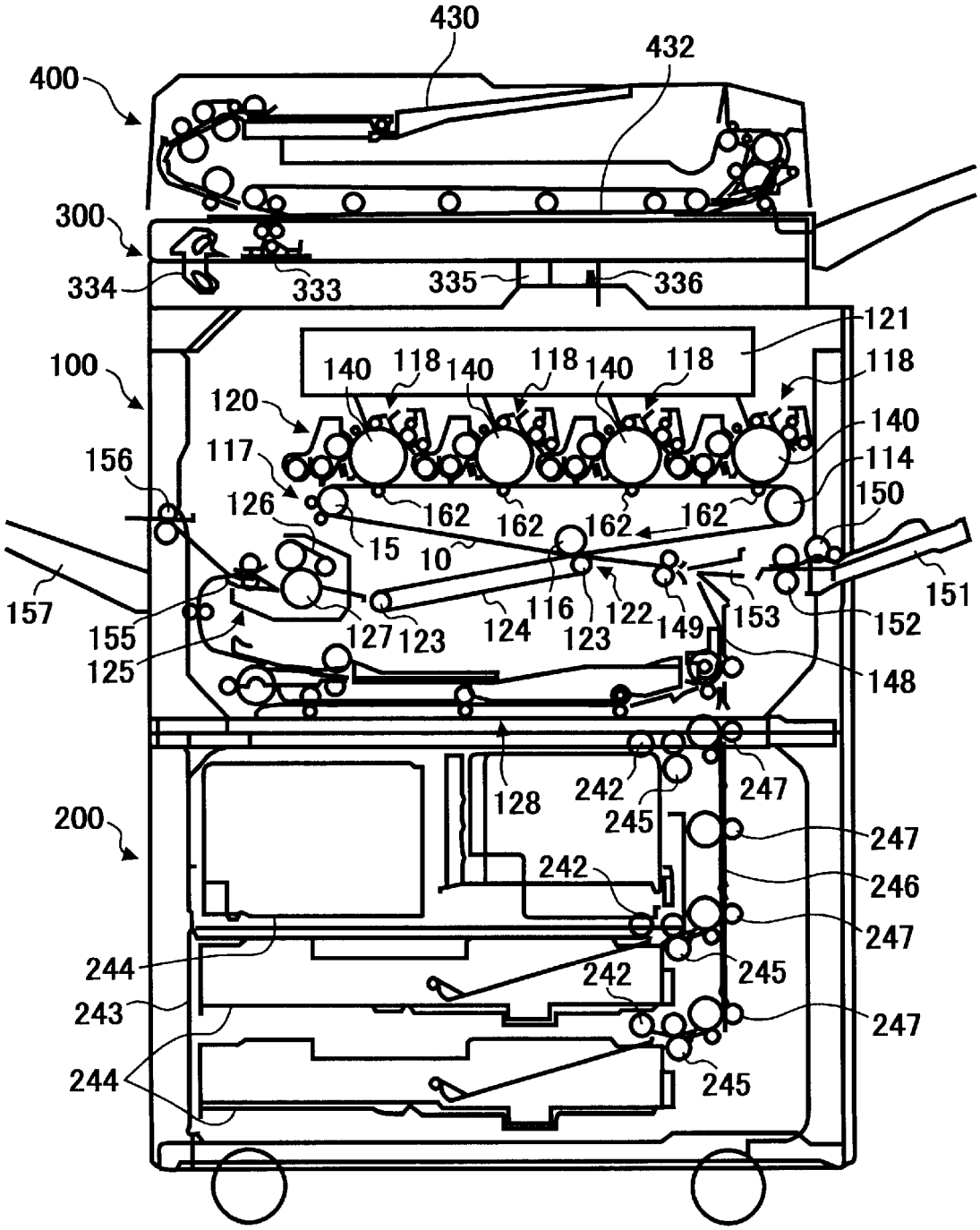
FIGS. 13 and 14 are schematic views illustrating the whole structure and partial structure of another embodiment of the image forming apparatus of the present invention.

FIG. 13 illustrates the whole construction of a color copier of a tandem type. FIG. 14 illustrates the construction of the developing section of the copier. FIG. 15 illustrates the structure of the intermediate transfer belt.

In FIG. 13, numerals 100, 200, 300 and 400 denotes a main body of the copier, a paper feeding unit, a scanner on the main body 100, and an automatic document feeder (i.e., an ADF).

In the main body 100, an endless intermediate transfer belt 110 is provided in the center thereof. As shown in FIG. 15, the belt 110 has a base layer 111 and an elastic layer 112 on the base layer 111. The base layer 111 is constituted of, for example, a non-extensible fluorine containing resin or a combination of an extensible rubber and a non-extensible cloth. The elastic layer 112 is constituted of, for example, a fluorine containing rubber or an acrylonitrile-butadiene rubber. The surface of the elastic layer 112 is coated with, for example, a fluorine containing resin to make a smooth surface layer 113.

As shown in FIG. 13, the belt 110 is rotated in the clockwise direction by support rollers 114, 115 and 116 while being tightened. At the left side of the support roller 115, a belt cleaner 117, which removes the toner remaining on the belt 110 after toner images are transferred onto a receiving sheet, is provided. Over the belt 110 tightened by the support rollers 114 and 115, four image forming devices 118 are arranged along the belt feeding direction to form a tandem type image forming device 120.

Over the tandem type image forming device 120, a light irradiator 121 is provided. Below the belt 110, a secondary transfer device 122 is provided. The secondary transfer device 122 has a construction in which an endless belt 124 (i.e., a secondary transfer belt 124) is tightened by two rollers 123. The secondary transfer belt 124 is pressed to the support roller 116 with the belt 110 therebetween to transfer the images on the belt 110 to a receiving sheet.

At the left side of the secondary transfer belt 124, a fixer 125 is provided which fixes the images on a receiving material. The fixer is constituted of an endless fixing belt 126 and a pressure roller 127.

The secondary transfer device 122 also has a function of feeding the receiving sheet to the fixer 125. Of course, a transfer roller or a non-contact charger may be used as the secondary transfer device 122.

As shown in FIG. 13, below the secondary transfer device 122 and the fixer 125, a reversing device 128 is provided which reverses the receiving sheet to form images on both sides of the sheet.

When a color copy is produced, at first an original is set on an original table 430 of the ADF 400. Alternatively, after the ADF is opened by hand, the original is manually set on a contact glass 432, and then the ADF is closed to hold the original.

When a copy operation is started by pushing a start switch (not shown), first and second moving members 433 and 434 move. Light is emitted by the first moving member 433 to irradiate the original. The light reflected at the original is reflected by the first moving member 433. The light is then reflected at a mirror of the second moving member 434 and is read by a reading sensor 436 after passing through a focus lens 435. Thus, the image of the original is read.

On the other hand, when the start switch is pushed, one of the support rollers 114, 115 or 116 is driven by a motor (not shown) to drive the other two rollers and to rotate the belt 110. At the same time, in each of the image forming devices 118, color images of black, yellow, magenta and cyan toner images are formed on respective photoreceptors 140 which are rotated. The four color images are then transferred one by one onto the belt 110, resulting in formation of a full color image.

On the other hand, when the start switch is pushed, one of feeding rollers 242 is selectively rotated to feed a selected receiving paper from one of paper cassettes 244 contained in a paper bank 243. The receiving paper is fed to a feeding passage 246 while being separated by a separation roller 245 from the following receiving paper. The receiving paper is then fed by a feeding roller 247 to a feeding passage 148 in the main body 100. The receiving paper is then stopped at a registration roller 149. When a receiving paper is manually fed from a manual paper feed tray 51, the receiving paper on the tray 151 is fed by a feeding roller 150. The receiving paper is fed to a feeding passage 153 while separating by a separating roller 152 and then stopped at the registration roller 149.

The registration roller 149 is timely rotated such that the full color image on the belt 110 is transferred onto the proper position of the receiving paper. The full color image is transferred onto the receiving paper at the nip of the belt 110 and the secondary transfer device 122.

The receiving paper having the full color image thereon is then fed to the fixer 125 by the secondary transfer device 122 to fix the image upon application of heat and pressure thereto. The receiving paper is discharged by a discharge roller 156 after properly setting a feed changing pick 155. The discharged copy sheet is stacked on a discharge tray 157.

When a double-sided copy is produced, the receiving paper is fed to a reversing device 128 by changing the feed changing pick 155. The reversed receiving paper is again fed to the transfer position to form an image on the back side of the receiving paper. The thus prepared double-sided copy is discharged on the discharge tray 157 by the discharge roller 156.

On the other hand, the surface of the belt 110 is cleaned by a belt cleaner 117 to remove the toner remaining thereon to be ready for the next image forming processes.

The registration roller 149 is typically grounded. However, a bias voltage may be applied thereto to remove paper dust thereon. For example, an electroconductive rubber roller, which has a diameter of 18 mm and in which an NBR rubber layer having a thickness of 1 mm is formed as a surface layer, is used as the registration roller 149 and a bias voltage is applied thereto. The volume resistivity thereof is preferably about $10^9$ Ωcm. The bias voltage applied to the side of the receiving paper on which images are to be transferred, is preferably about −800 V. On the backside of the receiving paper, a bias voltage of about +200 V is applied. In general, paper dust tends not to be fed to the photoreceptor 140 in the image forming method using an intermediate transfer medium, and therefore the registration roller 149 may be grounded. In addition, an AC overlapped DC bias may be applied thereto to uniformly charge the photoreceptor 140.

Thus, the surface of the receiving paper has a few minus charges after the receiving paper passes through the registration roller 149. Therefore, the conditions of the image transfer from the belt 110 to the receiving paper should be different from those when the registration roller 149 is grounded.

Figure 14:
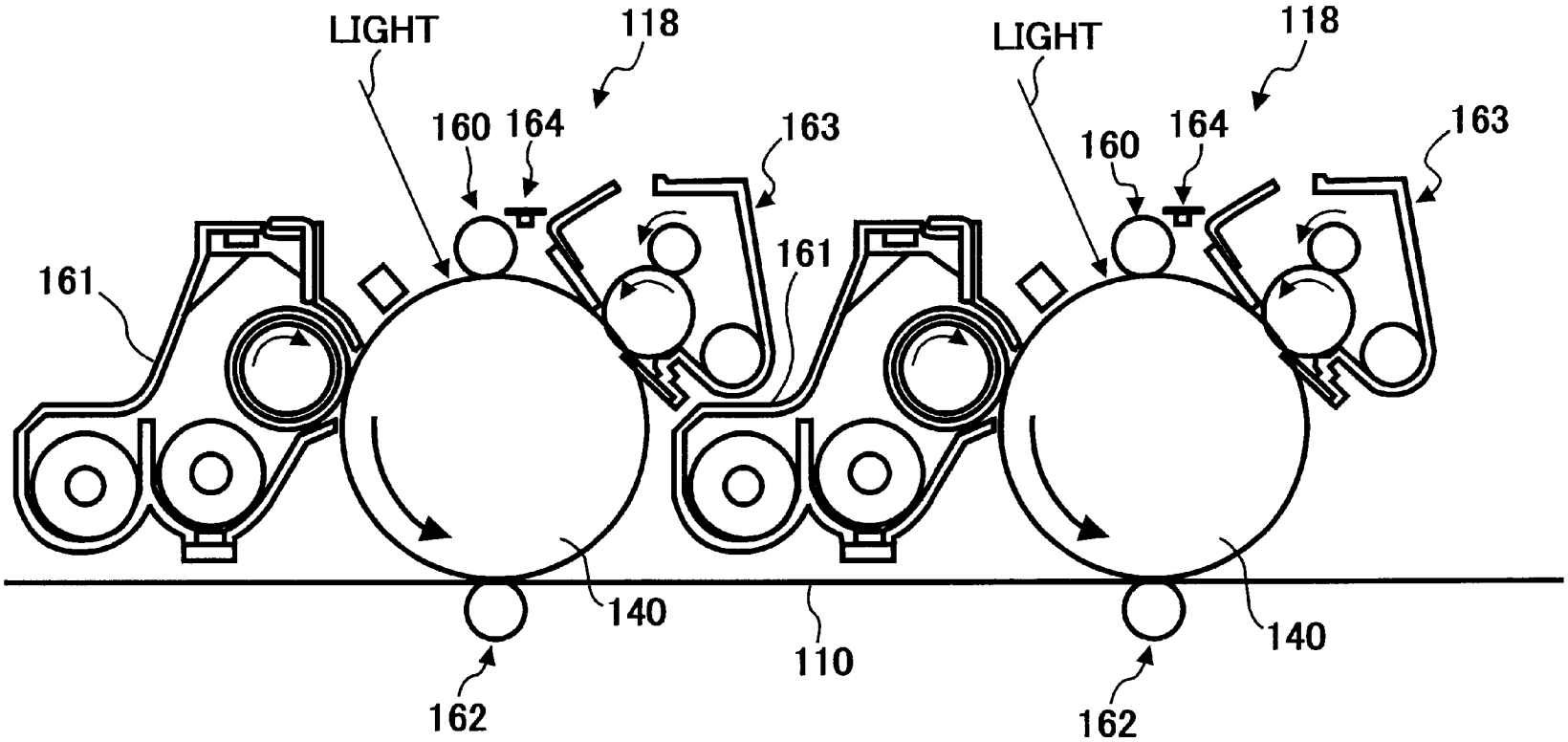
Figure 15:
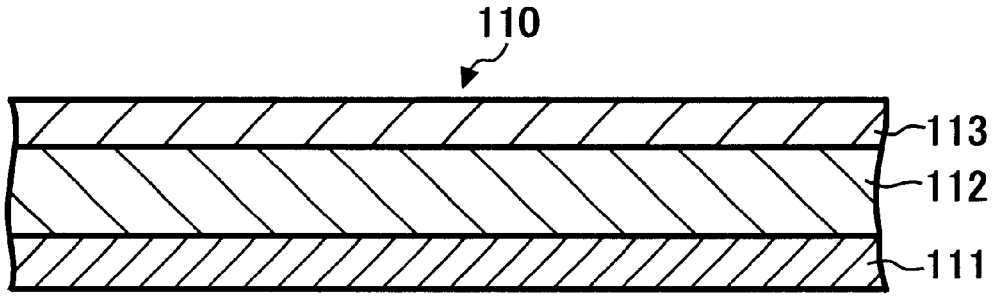
FIG. 15 is a schematic view illustrating the cross section of the intermediate transfer belt for use in the image forming apparatus of the present invention.

In each of the image forming device 118 in the tandem type image forming device 120, as shown in FIG. 14, a charger 160, an image developer 161, a primary transfer device 162, a cleaner 163, a discharger 164 etc. are arranged around the photoreceptor 140.

Then the intermediate transfer belt will be explained in detail. Conventionally, the intermediate transfer belt is made of a resin such as fluorine containing resins, polycarbonate resins and polyamide resins. In recent years, a belt in which all or part thereof is made of an elastic material is used as the intermediate transfer belt.

When a color image is transferred using a resin belt, the following problems tend to occur. A full color image is typically formed using four color toner layers. Therefore the full color image consists of various color images having one toner layer, two toner layers, three toner layers and four toner layers. The toner layers is pressed at the primary and secondary transfer processes, resulting in increase of cohesive force of the toner particles of the toner layers. When the cohesive force of the toner particles increases, undesired images, such as omissions in the center of character images, and omissions in the edge parts of solid images, tend to be produced.

The resin belt is hardly deformed because of having high hardness, and therefore the toner layers are strongly pressed, resulting in production of such image omissions in character images.

In recent years, there exists an increasing need to form images on various receiving materials such as Japan paper and intentionally-roughened paper. However, when a toner image is transferred onto a rough paper, an air space tends to be formed between the toner image and the rough paper, resulting in formation of image omissions. If the pressure is increased at the secondary transfer position to improve the adhesion between the toner image and the rough paper, the cohesive force of the toner particles increase, resulting in formation of image omission in the center of character images.

The elastic belt is used for forming good images without producing such image omissions.

The elastic belt has a relatively low hardness, and therefore deforms at an image transfer position. Therefore, even when a toner image is transferred on a receiving sheet such as rough paper or paper on which multiple toner layers are previously formed, the toner layer can be securely contacted to the receiving sheet without strongly pressing the toner image and the receiving sheet because the elastic belt deforms. Therefore, images having good evenness can be formed even on a rough paper without producing such image omissions.

Suitable resins for use in the elastic belt include polycarbonate, fluorine containing resins such as ethylene-tetrafluoroethylene (ETFE) and polyvinylidene fluoride (PVDF); styrene resins such as polystyrene, polychrolostyrene, poly-α-methyl styrene, styrene-butadiene copolymers, styrene-vinyl chloride copolymers, styrene-vinyl acetate copolymers, styrene-maleic acid copolymers, styrene-acrylate copolymers such as styrene-methyl acrylate copolymers, styrene-ethyl acrylate copolymers, styrene-butyl acrylate copolymers, styrene-octyl acrylate copolymers and styrene-phenyl acrylate copolymers, styrene-methacrylate copolymers such as styrene-methyl methacrylate copolymers, styrene-ethyl methacrylate copolymers, and styrene-phenyl methacrylate copolymers, styrene-methyl α-chloroacrylate, and styrene-acrylonitrile-acrylate copolymers; methyl methacrylate resins, butyl methacrylate resins, ethyl acryalte resins, butyl acrylate resins, modified acrylic resins such as silicone modified acrylic resins, vinyl chloride resin modified and acrylic-urethane resins, vinyl chloride resins, vinyl chloride-vinyl acetate copolymers, rosin modified maleic resins, phenolic resins, epoxy resins, polyester resins, polyester-polyurethane resins, polyethylene, polypropylene, polybutadiene, polyvinylidene chloride, ionomer resins, polyurethane resins, silicone resins, ketone resins, ethylene-ethyl acrylate copolymers, xylene resins, polyvinyl butyral resins, polyamide resins, modified polyphenyleneoxide resins, and the like resins. These are used alone or in combination.

In addition, the elastic rubbers and elastomers can also be used for the elastic belt. Specific examples of such materials include butyl rubbers, fluorine containing rubbers, acrylic rubbers, ethylene-propylene-diene-methylene (EPDM), acrylonitrile-butadiene rubbers (NBR), acrylonitrile-butadiene-styrene rubbers, natural rubbers, isoprene rubbers, styrene-butadiene rubbers, butadiene rubbers, ethylene-propylene rubbers, ethylene-propylene terpolymers, chloroprene rubbers, chlorosulfonated polyethylene, chlorinated polyethylene, urethane rubbers, syndiotactic 1,2-polybutadiene, epichlorohydrin rubbers, silicone rubbers, polysulfide rubbers, polynorbornene rubbers, hydrogenated nitrile rubbers, thermoplastic elastomers such as polystyrene elastomers, polyolefin elastomers, polyvinyl chloride elastomers, polyurethane elastomers, polyamide elastomers, polyurea elastomers, polyester elastomers, fluorine containing elastomers, and the like materials. These materials can be used alone or in combination.

Electroconductive materials can be added to the elastic belt to control the resistance. Specific examples of such materials include carbon black, graphite, powders of a metal such as aluminum and nickel, electroconductive metal oxides suchastinoxide, titaniumoxide, antimony oxide, indiumoxide, potassium titanate, antimony oxide-tin oxide complex oxides (ATO), indium oxide-tin oxide complex oxides (ITO), and the like materials. The electroconductive metal oxides may be coated by an insulating particles such as barium sulfate, magnesium silicate, and calcium carbonate.

The material for use in the surface layer of the elastic belt is not particularly limited. However, the surface layer preferably has poor adhesion with toner images to improve the secondary transfer efficiency. For example, layers can be used in which one or more lubricating powders and particles, which can reduce the surface energy and have lubricating property, such as fluorine containing resins, fluorine containing compounds, carbon fluoride, titanium dioxide, and silicon carbide are dispersed in one or more of polyurethane, polyester, and epoxy resins. Plural powders and/or particles having different particle sizes may be dispersed in such resins. In addition, a fluorine containing rubber layer in which fluorine atoms are richly included in the surface thereof by heating the fluorine containing rubber can be preferably formed as the surface layer to reduce the surface energy thereof.

The method for manufacturing the belt is not particularly limited. Centrifugal molding methods in which a belt is formed by adding constituents in a rotating cylinder, spraying methods which are preferably used for forming the surface layer, dipping methods in which a cylinder is dipped in a coating liquid, injection methods using inner and outer molds, and vulcanization/polish methods in which a compound wound around a mold is vulcanized and then polished, and the like methods can be used. These methods can be used alone or in combination.

The elastic belt is preferably less extensive to form good images thereon. In order to avoid elongation of the belt, for example, the following methods can be used:

(1) a rubber layer is formed on a resin belt having low elongation percentage; and (2) a material for decreasing elongation is added to a belt.

Specific examples of the material to decrease elongation for use in the core layer of the belt include natural fibers such as cotton and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenolic resin fibers; inorganic fibers such as carbon fibers, glass fibers and boron fibers; metal fibers such as iron fibers and copper fibers; and the like fibers. These fibers can be used alone or in combination and may be woven materials or threads.

Threads may be a single filament, and a thread in which plural filaments are twisted. The twisting methods are not particularly limited. Blended fabrics having plural kinds of fibers can also be used. In addition, the threads may be subjected to an electroconductive treatment.

As for the method for weaving threads, any known methods can be used. In addition, the fibers may be subjected to an electroconductive treatment.

The method for forming the core layer (i.e., the base layer 111) film including a fiber therein is not particularly limited. For example, the following methods can be used:

(1) a cover film is formed on an endless fiber which is set on a mold;

(2) an endless fiber is dipped in a liquid rubber and the like to form a cover layer thereon; and (3) a cover film is formed on threads which are spirally wound around a mold.

The thickness of the elastic layer formed on the core layer depends on the hardness of the elastic layer. When the elastic layer is too thick (about 1 mm or more), problems which occur are that cracks tend to form on the surface layer because the surface elongates and shrinks, and in addition, the images thereon also elongate and shrink.

The hardness HS of the elastic layer is preferably from 10° to 65° which is measured by a method based on JIS-A. The hardness should be controlled depending on the thickness of the belt. When the hardness is too low (i.e., too soft), it is difficult to prepare a belt having high dimensional accuracy because the belt shrinks or expands during molding.

In order to soften the belt, a method in which an oil is added to the belt is popular. However, when such belt is repeatedly used upon application of pressure thereto, the oil tends to breed therefrom, resulting in contamination of the photoreceptor, and thereby uneven horizontal stripe images are formed. The surface layer is formed to prevent the oil bleeding, however, it is difficult to select a material suitable for the surface layer.

To the contrary, when the hardness is too high, the resultant belt has less elasticity, resulting in formation of image omissions.

As mentioned above, the image forming apparatus of the present invention may have a single photoreceptor or plural photoreceptors. However, the image forming apparatus having plural photoreceptors as shown in FIG. 13 is preferable because color images having good image qualities can be produced at a high speed.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Substrate

Figure 4:
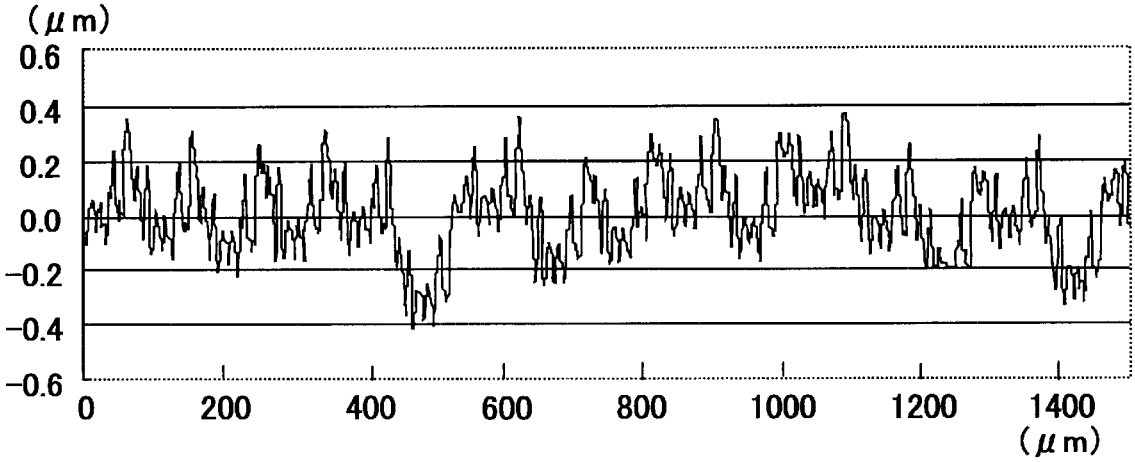
FIG. 4 is a profile of the surface of the substrate of the photoreceptor in Example 1 when measured by a surface analyzer.

The outer surface of an aluminum drum was cut by a diamond cutting tool to prepare a roughened aluminum drum having an outside diameter of 120 mm, a length of 346 mm and a thickness of 2.5 mm. When the outer surface of the aluminum drum was scanned by a surface analyzer, Surfcom 1400A, manufactured by Tokyo Seimitsu co., Ltd. The profile is shown in FIG. 4.

Formation of Undercoat Layer

The following components were mixed to prepare a resin solution.

| | |
|---|---|
| Acrylic resin (tradenamed as Acrydic A-460-60 and manufactured by Dainippon Ink and Chemicals, Inc.) | 15 |
| Melamine resin (tradenamed as Super Bekkamin L-121-60 and manufactured by Dainippon Ink and Chemicals, Inc.) | 10 |
| Methyl ethyl ketone | 80 |

The following components were mixed and dispersed for 12 hours using a ball mill to prepare an undercoat layer coating liquid.

| | |
|---|---|
| Resin solution prepared above | 105 |
| Titanium oxide powder (tradenamed as TM-1 and manufactured by Fuji Titanium Industry Co., Ltd.) | 90 |

The aluminum drum prepared above was dipped in the undercoat layer coating liquid and then pulled up vertically at a constant speed. The aluminum drum was carefully moved to a drying oven without changing the direction of the drum. The aluminum drum was heated at 140° C. for 20 minutes to dry the coated liquid. Thus, an undercoat layer having a thickness of 2.5 $\mu$m was formed on the aluminum drum.

Formation of Charge Generation Layer

The following components were mixed to prepare a resin solution.

| | |
|---|---|
| Butyral resin (tradenamed as S-lec BLS and manufactured by Sekisui Chemical Co., Ltd.) | 15 |
| Cyclohexanone | 150 |
| The following components were mixed and dispersed for hours using a ball mill to prepare a dispersion. | 48 |
| Resin solution prepared above | 165 |
| Trisazo pigment having the following formula | 10 |

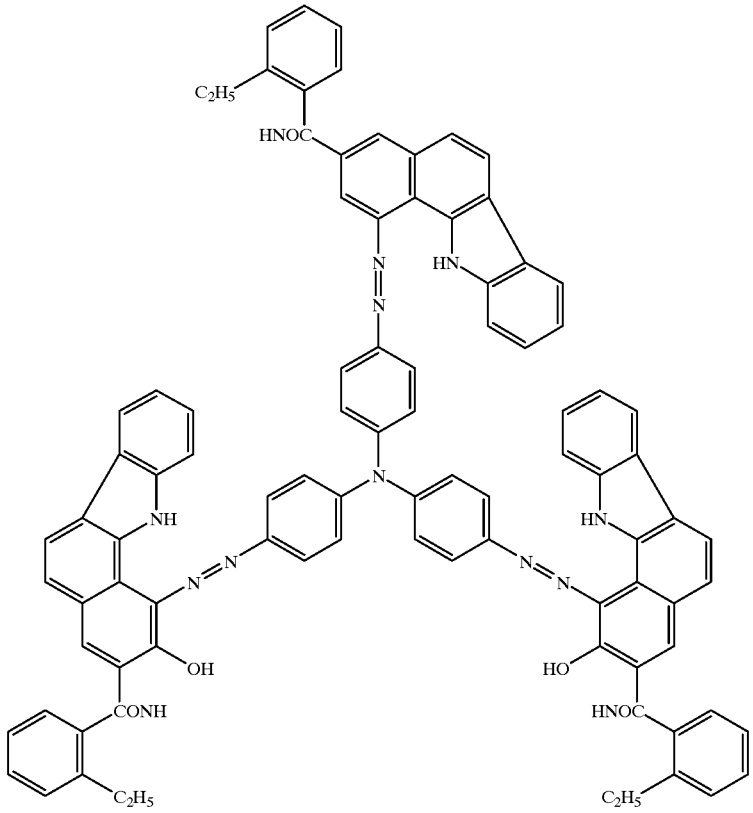

-continued

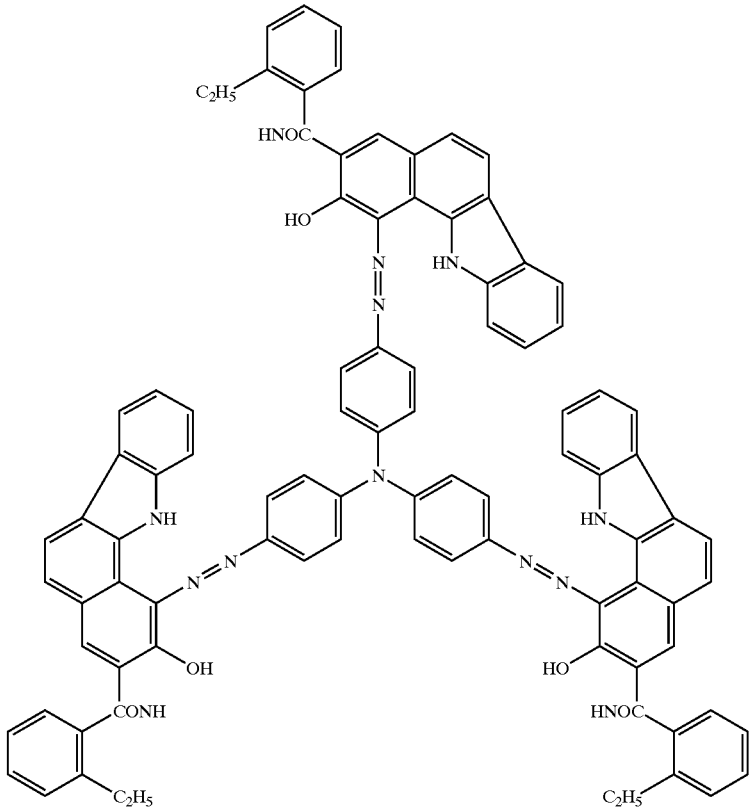

Then 210 parts of cyclohexanone were added to the dispersion and the mixture was further mixed for 3 hours. This dispersion was diluted with cyclohexanone so as to have a solid content of 1.5% by weight while being agitated. Thus a charge generation layer coating liquid was prepared.

The aluminum drum having the undercoat layer thereon was dipped into the charge generation layer coating liquid and then pulled up vertically at a constant speed. The coated liquid was dried at 120° C. for 20 minutes to dry the coated liquid. Thus, a charge generation layer having a thickness of about 0.2 μm was formed on the undercoat layer.

Formation of Charge Transport Layer

The following components were mixed to prepare a charge transport layer coating liquid.

Charge transport material having the following formula 6

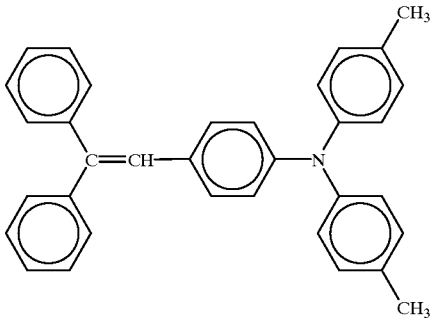

| | |
|---|---|
| Polycarbonate resin (tradenamed as Panlite K-1300 and manufactured by Teijin Chemicals Ltd.) | 10 |
| Silicone oil (tradenamed as KF-50 and manufactured by Shin-Etsu Chemical Co., Ltd.) | 0.002 |
| Methylene chloride | 90 |

The aluminum drum having the undercoat layer and charge generation layer was dipped into the charge transport layer coating liquid and then pulled up vertically at a constant speed. The coated liquid was dried at 120° C. for 20 minutes to prepare a charge transport layer having a thickness of about 23 μm.

Formation of Image

The thus prepared photoreceptor was set in a copier, PRETER 550, manufactured by Ricoh Co., Ltd. and using light having a wavelength of 780 nm and a spot diameter of 60 μm for image writing.

Figure 5:
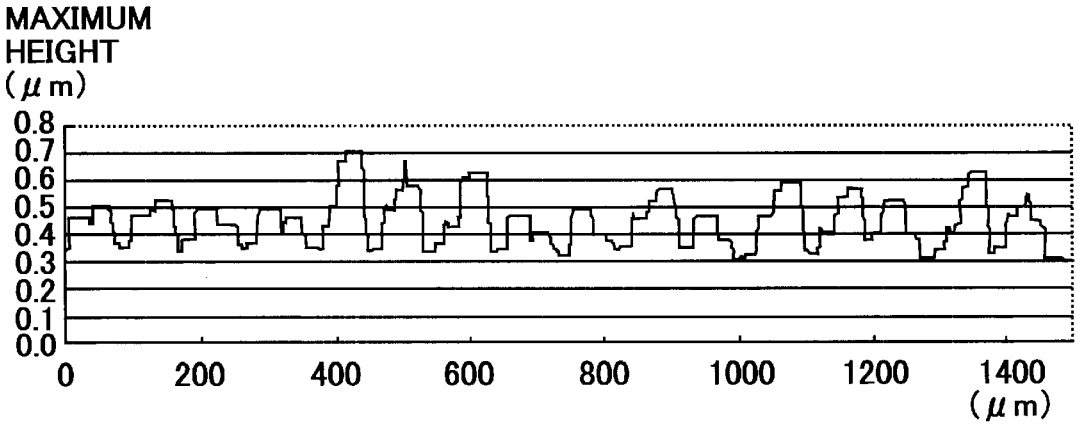
FIG. 5 is a curve illustrating the maximum height of the substrate used in Example 1 when the sampling range $\phi$ is 60 $\mu$m.

The maximum heights of the profile of the surface of the aluminum drum are shown in FIG. 5 when the maximum heights are obtained from the profile in FIG. 4 while sampling various parts of the profile in units length 8 (i.e., a sampling range) of 60 μm. In FIG. 5, the values of X axis represent the positions of the lower limits of the sampled ranges.

As can be understood from FIG. 5, the minimum value of the maximum heights was 0.30 μm. At this condition, $\lambda/(2n)\times1.03$ is as follows:

$$\lambda/(2n)\times1.03=0.78/(2\times1.85)\times1.03=0.22\ \mu m$$

Thus, the minimum value (0.30 μm) of the maximum heights is greater than $\lambda/(2n)\times1.03$ (i.e. 0.22 μm).

At this point, the refractive index of the charge transport layer was 1.85, which was measured by an ellipsometer.

When black and white half tone images were produced, uniform images without the undesired stripe image could be produced. In addition, when a color image of a landscape picture was copied, a high quality color copy was obtained.

Example 2

The procedures for preparation and evaluation of the photoreceptor in Example 1 were repeated except that the cutting operation of the aluminum drum was performed after the blade of the cutting tool was polished.

Figure 6:
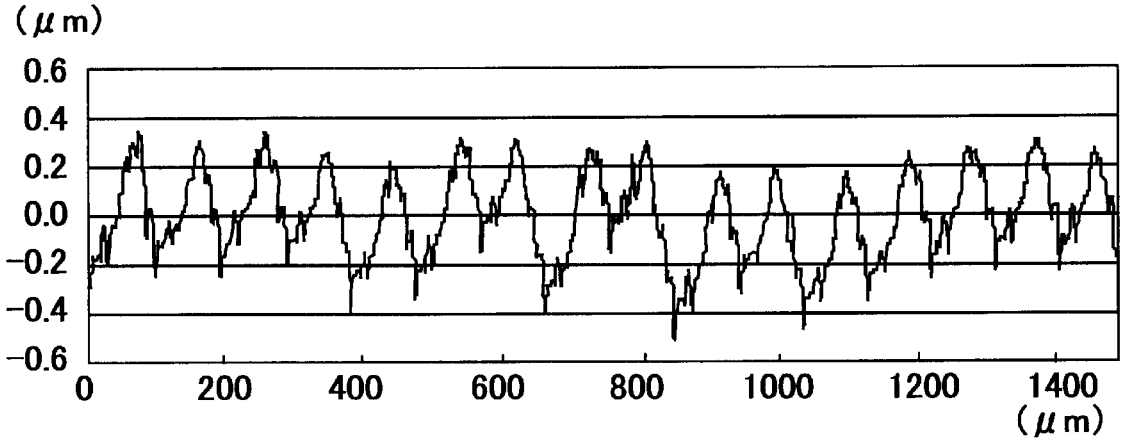
FIGS. 6 to 9 are schematic views illustrating the profiles and maximum height of the surfaces of the substrates used in Example 2 and Comparative Example 1.
Figure 7:
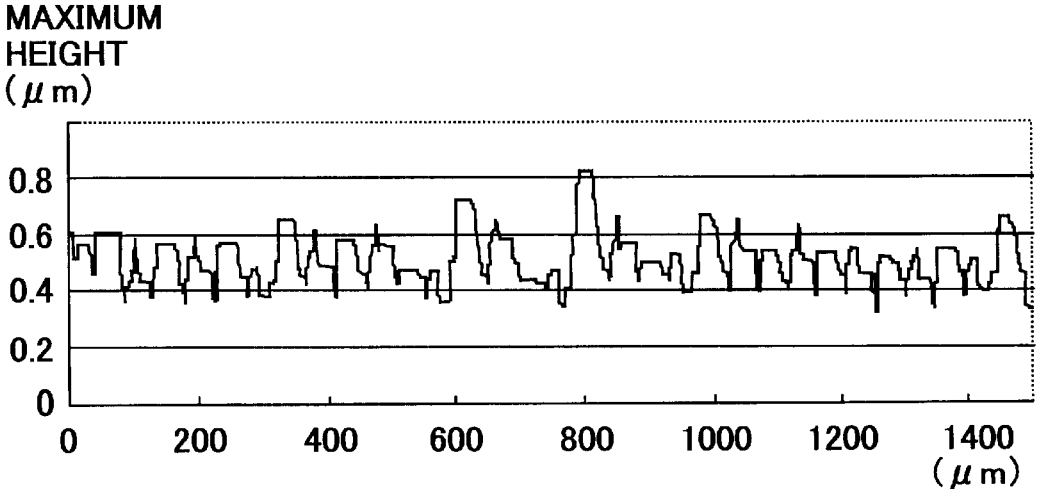

The profile of the surface of the aluminum substrate is shown in FIG. 6. In addition, the maximum heights are shown in FIG. 7 when the sampling range is 60 μm. As can be understood from FIG. 7, the minimum value of the maximum heights was 0.33 μm.

When black and white half tone images were produced, uniform images without the undesired stripe image could be produced. In addition, when a color image of a landscape picture was copied, a high quality color copy was obtained.

Comparative Example 1

The procedures for preparation and evaluation of the photoreceptor in Example 1 were repeated except that the cutting operation of the aluminum drum was performed after the cutting tool had been used for 1500 cutting operations.

Figure 8:
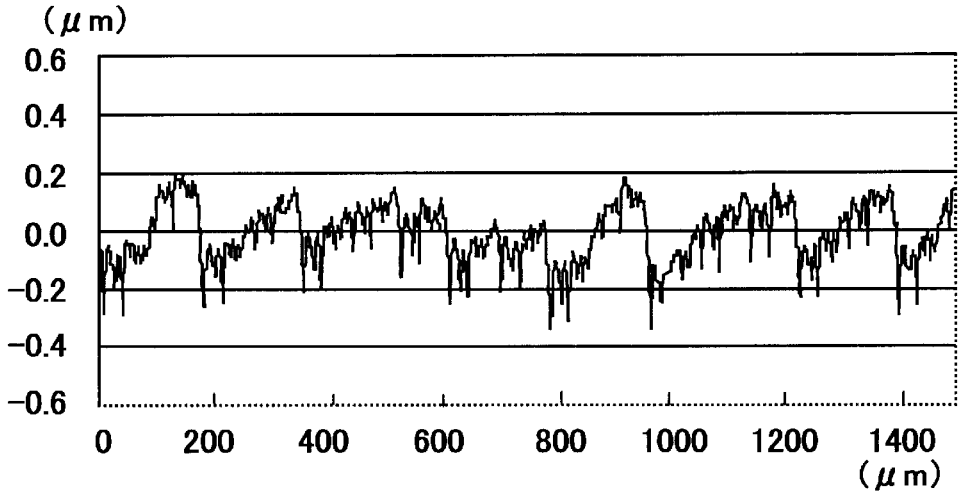
Figure 9:
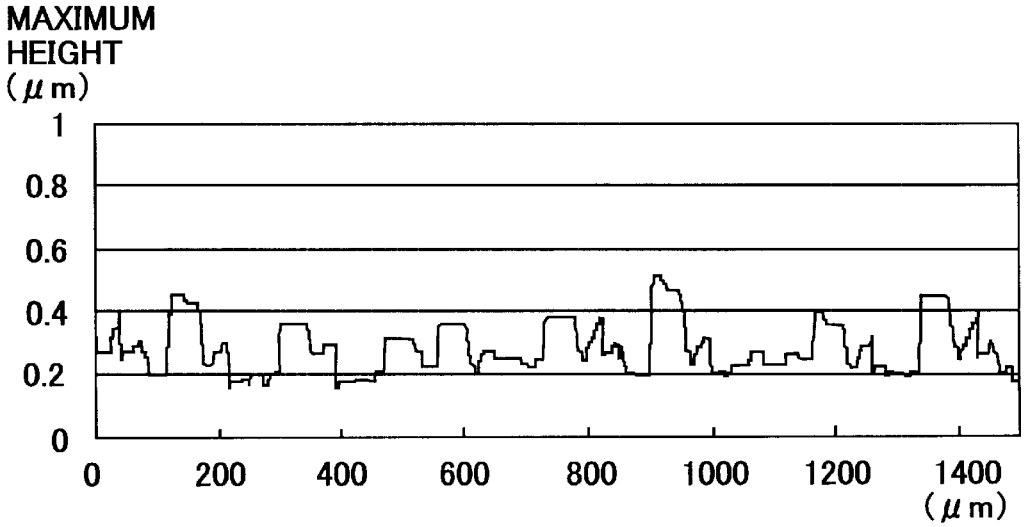

The profile of the surface of the aluminum substrate is shown in FIG. 8. In addition, the maximum heights are shown in FIG. 7 when the sampling range is 60 μm. As can be understood from FIG. 7, the minimum value of the maximum heights was 0.17 μm.

When black and white half tone images were produced, four pair of undesired stripe images were observed at the edge part of the images. In addition, stripes like grains whose interval was the same as the periphery of the photoreceptor were observed.

Further, when a color image of a landscape picture was copied, undesired stripe images were also observed at the edge part of the image. In addition, the color tone of an area of the color image, whose position is the same as that of the grain-like stripe images of the black and white half tone image, is clearly different from the other areas.

Comparative Example 2

The procedures for preparation and evaluation of the photoreceptor in Example 1 were repeated except that the cutting operation of the aluminum drum was performed after the blade of the cutting tool had been polished.

The maximum height was 0.19 μm when the sampling range was 60 μm.

When black and white half tone images were produced, four pair of undesired stripe images were observed at the edge part of the images.

Further, when a color image of a landscape picture was copied, undesired stripe images were also observed at the edge part of the image.

Example 3

The procedures for preparation and evaluation of the photoreceptor in Comparative Example 2 were repeated except that the light beam of the PRETER 550 was changed to 90 μm.

The maximum height was 0.22 μm when the sampling range was 90 μm.

When black and white half tone images were produced, slightly uneven stripe images were observed at the edge part of the images when the images were carefully observed.

When a color image of a landscape picture was copied, undesired images were not observed.

Example 4

The procedures for preparation and evaluation of the photoreceptor in Example 1 were repeated except that the cutting operation was performed using the cutting tool used in Example 1 and the thickness of the undercoat layer was changed to 7.5 μm.

The maximum height was 0.31 μm when the sampling range was 60 μm.

When black and white half tone images were produced, undesired stripe images were not observed.

In addition, when a color image of a landscape picture was copied, high quality images were obtained.

Example 5

The procedures for preparation and evaluation of the photoreceptor in Example 1 were repeated except that the cutting operation was performed using the cutting tool used in Example 4 and the thickness of the undercoat layer was changed to 16 μm.

The maximum height was 0.30 μm when the sampling range was 60 μm.

When black and white half tone images were produced, slightly uneven stripe images were observed at the edge part of the images.

When a color image of a landscape picture was copied, high quality images without undesired images were obtained.

Example 6

Formation of Substrate

The surface of an aluminum drum was cut by a diamond cutting tool of 2R to prepare a roughened aluminum drum having an outside diameter of 90 mm, a length of 352 mm and a thickness of 2 mm.

Formation of Undercoat Layer

The following components were mixed to prepare a resin solution.

| | |
|---|---|
| Acrylic resin (tradenamed as Acrydic A-460-60 and manufactured by Dainippon Ink and Chemicals, Inc.) | 15 |
| Melamine resin (tradenamed as Super Bekkamin L-121-60 and manufactured by Dainippon Ink and Chemicals, Inc.) | 10 |
| Methyl ethyl ketone | 80 |

The following components were mixed and dispersed for 12 hours using a ball mill to prepare an undercoat layer coating liquid.

| | |
|---|---|
| Resin solution prepared above | 105 |
| Titanium oxide powder (tradenamed as TM-1 and manufactured by Fuji Titanium Industry Co., Ltd.) | 90 |

The undercoat layer coating liquid was coated on the surface of the aluminum drum prepared above by a spray coating method while the aluminum drum was rotated. The aluminum drum was heated at 140° C. for 20 minutes to dry the coated liquid. Thus, an undercoat layer having a thickness of 5.5 μm was formed on the aluminum drum.

Figure 10:
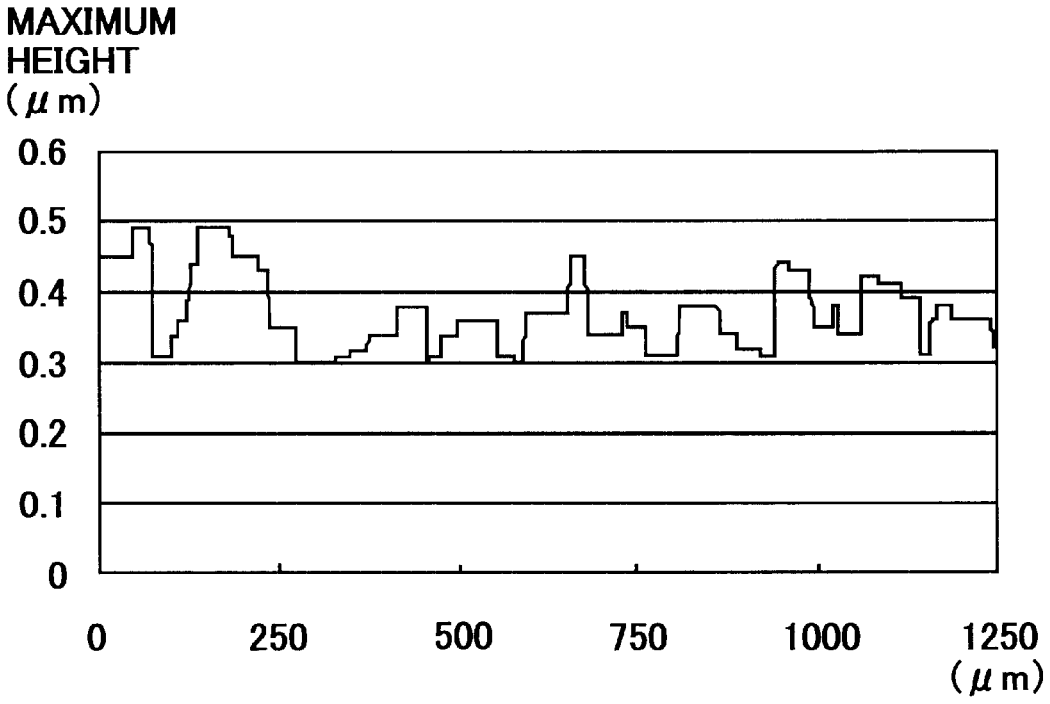
FIG. 10 is a schematic view illustrating the maximum height of the profile of the surface of the substrate used in Example 6.

The surface of the undercoat layer was scanned by a surface analyzer, Surfcom 1400A, manufactured by Tokyo Seimitsu Co., Ltd. to obtain the profile. As shown in FIG. 10, the minimum value of the maximum heights was 0.30 μm when the sampling range was 55 μm.

Formation of Charge Generation Layer

The following components were mixed to prepare a resin solution.

| | |
|---|---|
| Butyral resin (tradenamed as S-lec BLS and manufactured by Sekisui Chemical Co., Ltd.) | 15 |
| Cyclohexanone | 150 |
| The following components were mixed and dispersed for hours using a ball mill to prepare a dispersion. | 48 |
| Resin solution prepared above | 165 |
| Trisazo pigment having the following formula | 10 |

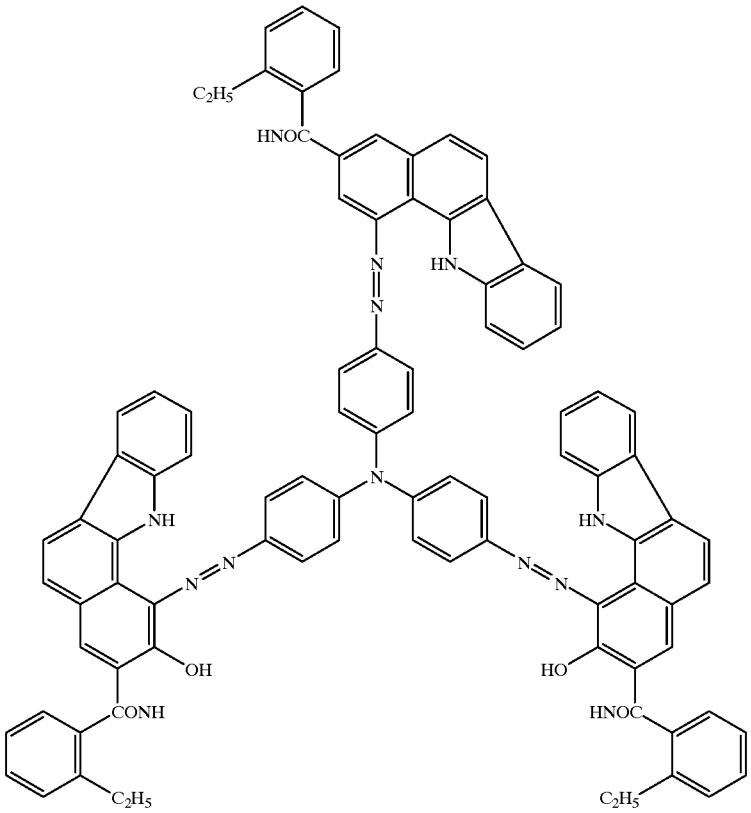

-continued

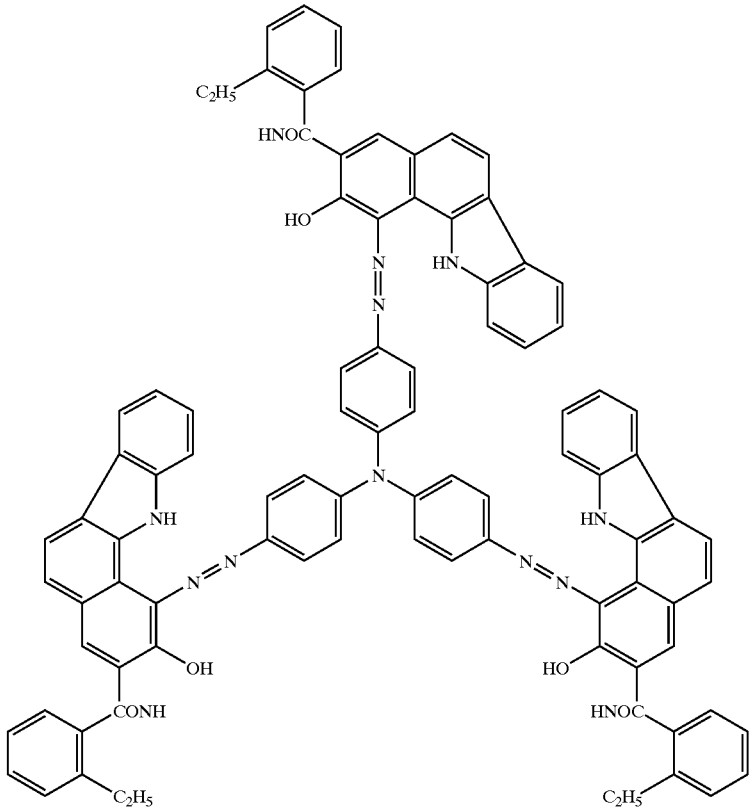

Then 210 parts of cyclohexanone were added to the dispersion and the mixture was further mixed for 3 hours. This dispersion was diluted with cyclohexanone so as to have a solid content of 1.5% by weight while being agitated. Thus a charge generation layer coating liquid was prepared.

The aluminum drum having the undercoat layer thereon was dipped into the charge generation layer coating liquid and then pulled up vertically at a constant speed. The coated liquid was dried at 120° C. for 20 minutes. Thus, a charge generation layer having a thickness of about 0.2 μm was formed on the undercoat layer.

Formation of Charge Transport Layer

The following components were mixed to prepare a charge transport layer coating liquid.

Charge transport material having the following formula 6

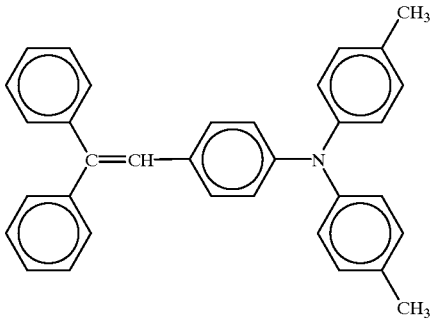

| | |
|---|---|
| Polycarbonate resin (tradenamed as Panlite K-1300 and manufactured by Teijin Chemicals Ltd.) | 10 |
| Silicone oil (tradenamed as KF-50 and manufactured by Shin-Etsu Chemical Co., Ltd.) | 0.002 |
| Methylene chloride | 90 |

The aluminum drum having the undercoat layer and charge generation layer was dipped into the charge transport layer coating liquid and then pulled up vertically at a constant speed. The coated liquid was dried at 120° C. for 20 minutes to prepare a charge transport layer having a thickness of about 24 μm.

Formation of Image

The thus prepared photoreceptor was set in a copier, Imagio Color 2800 manufactured by Ricoh Co., Ltd., which is modified so as to emit light having a wavelength of 780 nm and a spot diameter of 55 μm for image writing and to form 256 levels of half tone images using a combination of a pulse modulation and a power modulation.

When black and white half tone images were produced, uniform images without undesired stripe images could be produced. In addition, when a color image of a landscape picture was copied, a high quality color copy was obtained.

At this condition, the parameter λ(2n) is as follows:

$$\lambda/(2n)\times 0.78/(2\times 1.85)\times 0.21\ \mu m$$

Thus, the minimum value (0.30 μm) of the maximum heights is greater than μ/(2n) (i.e. 0.21 μm).

Example 7 and Comparative Example 3

Formation of Substrate

The aluminum drum used in Example 6 was subjected to a honing treatment to roughen the surface of the aluminum drum.

The surface of the aluminum drum was scanned by the surface analyzer, Surfcom 1400A, manufactured by Tokyo Seikitsu Co., Ltd. The Arithmetical Mean Deviation of the Profile (Ra) of the surface was 0.39 μm.

It is assumed that a photoreceptor having this aluminum substrate is used for the following image forming apparatuses:

| | Image writing conditions of image forming apparatus | |
|---|---|---|
| | Example 7 | Comparative Ex. 4 |
| Wavelength of light used for image writing | 780 nm | 780 nm |
| Spot diameter of light used for image writing | 70 μm | 54 μm |

When the sampling range was 70 μm (Example 7) and 54 μm (Comparative Example 3), the maximum height of the profile of the surface of the aluminum drum was 0.26 μm (in Example 7) and 0.20 μm (in Comparative Example 3), respectively.

In this case, λ/(2n) is as follows:

$$\lambda/(2n)\times 1.03=0.78/(2\times 1.85)\times 1.03=0.22\ \mu m$$

Therefore, when the spot diameter is 70 μm, the maximum height is 0.26 μm and is greater than λ/(2n)×1.03 (i.e., 0.22). Namely this image forming system is an embodiment of the present invention (Example 7). To the contrary, when the spot diameter is 54 nm, the maximum height is 0.20 μm and is less than λ/(2n)×1.03 (i.e., 0.22). Namely this image forming system is a comparative example (Comparative Example 3).

Formation of Undercoat Layer

The undercoat layer was formed on the aluminum substrate in the same way as performed in Example 6.

The surface of the undercoat layer was scanned by the surface analyzer, Surfcom 1400A, to obtain the profile of the surface thereof.

When the sampling range was 70 μm (in Example 7) and 54 μm (in Comparative Example 3), the maximum height of the profile of the surface of the undercoat layer was 0.25 μm (Example 7) and 0.18 μm (Comparative Example 3), respectively.

Therefore, when the spot diameter is 70 μm, the maximum height is 0.25 μm and is greater than λ/(2n) (i.e., 0.21). Namely this image forming system is an embodiment of the present invention (Example 7). To the contrary, when the spot diameter is 54 nm, the maximum height is 0.18 μm and is less than λ/(2n) (i.e., 0.21). Namely this image forming system is a comparative example (Comparative Example 3).

Formation of Charge Generation Layer

The charge generation layer was formed on the aluminum substrate in the same way as performed in Example 6.

Formation of Charge Transport Layer

The procedure for preparation of the charge transport layer in Example 6 was repeated except that the pulling up speed of the aluminum drum was changed at the center area of the aluminum drum to form a charge transport layer having an uneven thickness in the center area thereof. The thickness of the charge transport layer was changed in the direction H (as shown in FIG. 2) of the photoreceptor at a rate of about 0.6 μm per 10 mm.

Formation of Image

The thus prepared photoreceptor was set in a copier, Imagio Color 2800 manufactured by Ricoh Co., Ltd., which is modified so as to emit light having a wavelength of 780 nm and a spot diameter of 70 or 54 μm for image writing and to form 256 levels of half tone images using a combination of a pulse modulation and a power modulation.

When black and white half tone images were produced using the light having a spot diameter of 70 μm, uniform images without undesired stripe images could be produced. (Example 7) To the contrary, when black and white half tone images were produced using the light having a spot diameter of 54 μm, three pairs of undesired stripe images were produced. (Comparative Example 3)

Example 8

Formation of Substrate

The procedure for preparation of the photoreceptor in Example 6 was repeated except that the pressure in the honing treatment for the substrate was increased by 1.4 times.

When the sampling range was 54 μm, the maximum height of the profile of the surface of the substrate was 0.26 μm. In addition, when the sampling range was 54 μm, the maximum height of the profile of the surface of the undercoat layer was 0.25 μm.

The photoreceptor was evaluated in the same way as performed in Example 6. When black and white half tone images were produced, uniform images without undesired stripe images could be produced. In addition, when a color image of a landscape picture was copied, a high quality color copy was obtained.

Examples 9 to 13 and Comparative Examples 4 and 5

The procedures for preparation and evaluation of the photoreceptor in Example 6 were repeated except that when the undercoat layer was formed by the spray coating method, the discharge rate of the coating liquid from a nozzle was changed to form undercoat layers having different surface conditions.

The results are shown in Table 1.

TABLE 1

| | Minimum value of maximum height | Image qualities |
|---|---|---|
| Ex. 9 | 0.23 μm | High quality images was obtained |
| Ex. 10 | 0.25 μm | High quality images was obtained |
| Ex. 11 | 0.28 μm | High quality images was obtained |
| Ex. 12 | 0.33 μm | High quality images was obtained |
| Ex. 13 | 0.40 μm | High quality images was obtained |
| Comp. Ex. 4 | 0.19 μm | Stripe images were observed at the edge part of the images |
| Comp. Ex. 5 | 0.15 μm | Stripe images were observed at the edge part of the images. grain-like stripe images were observed at the center area of the images. |

Example 14

The procedures for preparation of the photoreceptor in Example 8 was repeated except that the undercoat layer was coated by a spray coating method.

When the sampling range was 46 μm, the maximum height of the profile of the surface of the undercoat layer was 0.23 μm.

The photoreceptor was set in a copier, Imagio Color 2800 manufactured by Ricoh Co., Ltd., which is modified so as to emit light having a wavelength of 780 nm and a spot diameter of 46 μm for writing latent images having a resolution of 1200 dpi.

When black and white half tone images were produced, uniform images could be produced. In addition, when a color image of a landscape picture was copied, a color copy having excellent image quality could be obtained.

When an anime cell image was copied and the copy image was carefully observed using a magnifying glass, some image omissions were observed around high density images. The omissions could hardly be observed by naked eyes.

Example 15

Formation of Intermediate Transfer Belt

The following components were mixed and dispersed to prepare a dispersion.

| | |
|---|---|
| Polyvinylidene fluoride (PVDF) | 100 |
| Carbon black | 18 |
| Dispersant | 3 |
| Toluene | 400 |

A cylindrical mold was dipped into the dispersion and then pulled up at a speed of 10 mm/sec. The dispersion coated on the mold was dried at room temperature to form thereon a film of PVDF including carbon black therein and having a thickness of 75 μm. This operation was repeated to form a film of PVDF having a thickness of 150 μm.

The following components were mixed and dispersed to prepare a dispersion.

| | |
|---|---|
| Polyurethane prepolymer | 100 |
| Crosslinking agent (isocyanate compound) | 3 |
| Carbon black | 20 |
| Dispersant | 3 |
| Methyl ethyl ketone | 500 |

The mold having the PVDF film thereon was dipped into the thus prepared dispersion and pulled up at a speed of 30 mm/sec. The coated dispersion was dried at room temperature. This operation was repeated to form an urethane polymer layer having a thickness of 150 μm.

The following components were mixed to prepare a dispersion.

| | |
|---|---|
| Polyurethane prepolymer | 100 |
| Crosslinking agent (isocyanate compound) | 3 |
| Polytetrafluoroethylene powder | 50 |
| Dispersant | 4 |
| Methyl ethyl ketone | 500 |

The mold having the PVDF layer and the polyurethane layer thereon was dipped into the thus prepared dispersion and pulled up at a speed of 30 mm/sec. The coated dispersion was dried at room temperature. This operation was repeated to form a polyurethane surface layer having a thickness of 5 μm and including a particulate polytetrafluoroethylene therein. The mold was heated at 130° C. for 2 hours to crosslink the polyurethane.

Thus, an intermediate transfer belt having a resin (PVDF) layer having a thickness of 150 μm, an elastic layer (urethane polymer layer) having a thickness of 150 μm, and a surface layer having a thickness of 5 μm was prepared.

The procedure for evaluation of the photoreceptor in Example 14 was repeated except that this intermediate transfer belt was used. When an anime cell image is copied and the copy image was carefully observed using a magnifying glass, image defects were not found, and high quality image was obtained.

This document claims priority and contains subject matter related to Japanese Patent Application No. 2000-114902 filed on Apr. 17, 2000, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

at least one photoreceptor including, a photosensitive layer overlying a surface of an electroconductive substrate and having upper and lower surfaces with the lower surface closer to the electroconductive substrate than the upper surface; and a light irradiator configured to irradiate the photoreceptor with a light beam having a wavelength $\lambda$ represented in units of micrometers and a diameter $\phi$ represented in units of micrometers to form a dot latent image on the photoreceptor, wherein a maximum height in a part of a profile of the lower surface of the photosensitive layer is not less than $\lambda/(2n)$ in a sampling range of $\phi$, where n is a refractive index of the photosensitive layer at the wavelength $\lambda$.

2. The image forming apparatus according to claim 1, wherein the diameter $\phi$ of the light beam is not greater than 60 μm.

3. The image forming apparatus according to claim 1, wherein the refractive index of the photosensitive layer ranges from 1.2 to 2.0.

4. The image forming apparatus according to claim 1, wherein the light irradiator is configured to irradiate the photoreceptor with a light beam produced by a multivalued half tone reproducing method.

5. The image forming apparatus according to claim 1, wherein the light irradiator is configured to form a dot latent image with a density not less than 1000 dots per inch.

6. The image forming apparatus according to claim 1, wherein the light irradiator is configured to irradiate the photoreceptor with plural light beams each having a wavelength represented in units of micrometers and a diameter $\phi$ represented in units of micrometers.

7. The image forming apparatus according to claim 1, further comprising:

a charger configured to charge the photoreceptor before the light irradiator irradiates the photoreceptor; and an image developer configured to develop the dot latent image with plural developers comprising different color toners to form plural color images on the photoreceptor.

8. The image forming apparatus according to claim 7, further comprising:

an intermediate transfer medium, wherein the plural color images formed on the photoreceptor are transferred on the intermediate transfer medium to form a color image thereon.

9. The image forming apparatus according to claim 8, wherein the intermediate transfer medium comprises an elastic medium.

10. The image forming apparatus according to claim 7, comprising:

at least two of said photoreceptors, wherein the plural color images are formed on the at least two photoreceptors.

11. An image forming apparatus comprising:

at least one photoreceptor including, an electroconductive substrate, an undercoat layer located on the electroconductive substrate and having an upper and a lower surface, and a photosensitive layer in contact with the upper surface of the undercoat layer; and a light irradiator configured to irradiate the photoreceptor with a light beam having a wavelength $\lambda$ represented in units of micrometers and a diameter $\phi$ represented in units of micrometers to form a dot latent image on the photoreceptor, wherein a maximum height in a part of a profile of the upper surface of the undercoat layer is not less than $\lambda/(2n)$ in a sampling range of $\phi$, where n is a refractive index of the photosensitive layer at the wavelength $\lambda$.

12. The image forming apparatus according to claim 11, wherein the diameter $\phi$ of the light beam is not greater than 60 $\mu$m.

13. The image forming apparatus according to claim 11, wherein the refractive index of the photosensitive layer ranges from 1.2 to 2.0.

14. The image forming apparatus according to claim 11, wherein the light irradiator is configured to irradiate the photoreceptor with a light beam produced by a multivalued half tone reproducing method.

15. The image forming apparatus according to claim 11, wherein the light irradiator is configured to form a dot latent image with a density not less than 1000 dots per inch.

16. The image forming apparatus according to claim 11, wherein the light irradiator is configured to irradiate the photoreceptor with plural light beams each having a wavelength $\lambda$ represented in units of micrometers and a diameter $\phi$ represented in units of micrometers.

17. The image forming apparatus according to claim 11, further comprising:

a charger configured to charge the photoreceptor before the light irradiator irradiates the photoreceptor; and an image developer configured to develop the dot latent image with plural developers comprising different color toners to form plural color images on the photoreceptor.

18. The image forming apparatus according to claim 17, further comprising:

an intermediate transfer medium, wherein the plural color images formed on the photoreceptor are transferred on the intermediate transfer medium to form a color image thereon.

19. The image forming apparatus according to claim 18, wherein the intermediate transfer medium comprises an elastic medium.

20. The image forming apparatus according to claim 17, comprising:

at least two photoreceptors, wherein the plural color images are formed on the at least two photoreceptors.

21. An image forming apparatus comprising:

at least one photoreceptor including a photosensitive layer overlying a surface of an electroconductive substrate; and a light irradiator configured to irradiate the photoreceptor with a light beam having a wavelength $\lambda$ represented in units of micrometers and a diameter $\phi$ represented in units of micrometers to form a dot latent image on the photoreceptor, wherein a maximum height in a part of a profile of the surface of the electroconductive substrate is not less than $\{\lambda/(2n)\}\times 1.03$ in a sampling range of $\phi$, where n is a refractive index of the photosensitive layer at the wavelength $\lambda$.

22. The image forming apparatus according to claim 21, wherein the photoreceptor further comprises an undercoat layer between the photosensitive layer and the electroconductive substrate and the undercoat layer has a thickness not greater than 15 $\mu$m.

23. The image forming apparatus according to claim 22, wherein the diameter $\phi$ of the light beam is not greater than 60 $\mu$m.

24. The image forming apparatus according to claim 22, wherein the refractive index of the photosensitive layer ranges from 1.2 to 2.0.

25. The image forming apparatus according to claim 22, wherein the light irradiator is configured to irradiate the photoreceptor with a light beam produced by a multivalued half tone reproducing method.

26. The image forming apparatus according to claim 22, wherein the light irradiator is configured to form a dot latent image with a density not less than 1000 dots per inch.

27. The image forming apparatus according to claim 22, wherein the light irradiator is configured to irradiate the photoreceptor with plural light beams each having a wavelength $\lambda$ represented in units of micrometers and a diameter $\phi$ represented in units of micrometers.

28. The image forming apparatus according to claim 22, further comprising:

a charger configured to charge the photoreceptor before the light irradiator irradiates the photoreceptor; and an image developer configured to develop the dot latent image with plural developers comprising different color toners to form plural color images on the photoreceptor.

29. The image forming apparatus according to claim 28, further comprising:

an intermediate transfer medium, wherein the plural color images formed on the photoreceptor are transferred on the intermediate transfer medium to form a color image thereon.

30. The image forming apparatus according to claim 29, wherein the intermediate transfer medium comprises an elastic medium.

31. The image forming apparatus according to claim 28, comprising:

at least two of said photoreceptor, wherein the plural color images are formed on the at least two photoreceptors.

32. An electrophotographic photoreceptor for an image forming apparatus, comprising:

an electroconductive substrate; and a photosensitive layer overlying a surface of the electroconductive substrate and having upper and lower surfaces with the lower surface closer to the surface of the electroconductive substrate than the upper surface, wherein a latent image is formed on the photosensitive layer by exposure to a light beam having a wavelength of $\lambda$ represented in units of micrometers and a diameter $\phi$ represented in units of micrometers, and wherein a maximum height in a part of a profile of the lower surface of the photosensitive layer is not less than $\lambda/(2n)$ in a sampling range of $\phi$, where n is a refractive index of the photosensitive layer at the wavelength of $\lambda$.

33. An electrophotographic photoreceptor for image forming apparatus, comprising:

an electroconductive substrate;

an undercoat layer located on the electroconductive substrate and including an upper and a lower surface; and a photosensitive layer located on the undercoat layer in contact with the upper surface of the undercoat layer, wherein a latent image is formed on the photosensitive layer by exposure to a light beam having a wavelength of $\lambda$ represented in units of micrometers and a diameter $\phi$ represented in units of micrometers, and wherein a maximum height in a part of a profile of the upper surface of the undercoat layer is not less than $\lambda/(2n)$ in a sampling range of $\phi$, where n is a refractive index of the photosensitive layer at the wavelength of $\lambda$.

34. An electrophotographic photoreceptor for an image forming apparatus, comprising:

an electroconductive substrate; and a photosensitive layer overlying a surface of the electroconductive substrate, wherein a latent image is formed on the photosensitive layer by exposure to a light beam having a wavelength of $\lambda$ represented in units of micrometers and a diameter $\phi$ represented in units of micrometers, and wherein a maximum height in a part of a profile of the surface of the electroconductive substrate is not less than $\{\lambda/(2n)\}\times 1.03$ in a sampling range of $\phi$, where n is a refractive index of the photosensitive layer at the wavelength of $\lambda$.

35. The photoreceptor according to claim 34, further comprising:

an undercoat layer located between the photosensitive layer and the electroconductive substrate, wherein the undercoat layer has a thickness not greater than 15 $\mu$m.

* * * * *